US009323181B2

(12) United States Patent
Teramoto

(10) Patent No.: US 9,323,181 B2
(45) Date of Patent: Apr. 26, 2016

(54) IMAGE FORMING APPARATUS, TRANSFER CURRENT CONTROL METHOD AND STORAGE MEDIUM

(71) Applicant: Sharp Kabushiki Kaisha, Osaka-shi, Osaka (JP)

(72) Inventor: Yudai Teramoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/686,912

(22) Filed: Apr. 15, 2015

(65) Prior Publication Data

US 2015/0309446 A1 Oct. 29, 2015

(30) Foreign Application Priority Data

Apr. 23, 2014 (JP) ..... 2014-089447

(51) Int. Cl.
*G03G 15/16* (2006.01)
*G03G 15/00* (2006.01)

(52) U.S. Cl.
CPC ..... *G03G 15/16* (2013.01); *G03G 15/1605* (2013.01); *G03G 15/80* (2013.01); *G03G 15/1645* (2013.01); *G03G 15/1675* (2013.01); *G03G 2215/0132* (2013.01)

(58) Field of Classification Search
CPC ..... G03G 15/16; G03G 15/1675; G03G 15/5054; G03G 15/80; G03G 2215/16; G03G 2215/1614; G03G 2215/1623
USPC ..... 399/66, 302, 314
See application file for complete search history.

(56) References Cited

U.S. PATENT DOCUMENTS

| | | | | |
|---|---|---|---|---|
| 6,282,386 | B1 * | 8/2001 | Ishii | G03G 15/1675 399/66 X |
| 7,039,331 | B2 | 5/2006 | Yoshida | |
| 2010/0028033 | A1 * | 2/2010 | Miura | G03G 15/1675 399/66 |
| 2010/0129105 | A1 * | 5/2010 | Furukawa | G03G 15/1675 399/66 |
| 2013/0243462 | A1 * | 9/2013 | Ono | G03G 15/1675 399/66 |

FOREIGN PATENT DOCUMENTS

JP 2005-122019 A 5/2005

* cited by examiner

*Primary Examiner* — Sophia S Chen
(74) *Attorney, Agent, or Firm* — Keating & Bennett, LLP

(57) ABSTRACT

An image forming apparatus includes a transfer belt that is stretched over a plurality of rollers to be circumferentially moved, a transfer roller, a transfer power supply, etc., and transfers a toner image formed on an image carrying member to a recording medium using the transfer belt. The image forming apparatus includes a transfer current control unit that measures a use situation of the transfer belt and controls a transfer current to be supplied to the transfer roller based on the use situation. Since re-transfer of a toner is prevented by controlling the transfer current that flows into the transfer roller based on the use situation of the transfer belt, it is possible to prevent, without extending preliminary operation time of the transfer belt, a poor image due to a contact trace that occurs on the transfer belt.

11 Claims, 7 Drawing Sheets

IMAGE FORMING APPARATUS, TRANSFER CURRENT CONTROL METHOD AND STORAGE MEDIUM

CROSS REFERENCE OF RELATED APPLICATION

The disclosure of Japanese patent application No. 2014-089447 filed on Apr. 23, 2014 is incorporated by reference.

BACKGROUND OF THE INVENTION

1. Field of the Invention

The present invention relates to an image forming apparatus, a transfer current control method and a storage medium, and more specifically, an image forming apparatus that a toner image formed on an image carrying member is transferred to a recording medium using a transfer belt that is stretched over a plurality of rollers to be circumferentially moved, a transfer current control method and a storage medium.

2. Description of the Related Art

An example of the conventional image forming apparatus is disclosed in Japanese patent application laying-open No. 2005-122019 [G03G 15/16, G03G 15/02, G03G 15/20, G03G 21/14] (Patent Literature 1) laid-open on May 12, 2005. The image forming apparatus of Patent Literature 1 comprises a transfer belt (movable member) that is stretched over a plurality of rollers to be circumferentially moved, a detector that detects a temperature of the transfer belt and a storage that stores a detected temperature by means of the detector when an apparatus power supply is turned off. Then, if the detected temperature when the apparatus power supply is turned off is higher than a predetermined temperature, that is, when there is a possibility that a contact trace (creep deformation) of a recessed shape occurs on the transfer belt in a contacting portion with the roller, a preliminary operation for a long time that is longer than preliminary operation time (warm-up time) in usual stabilization control is performed when the apparatus power supply is turned on again.

That is, in a situation that the contact trace occurs on the transfer belt in the technology of Patent Literature 1, the preliminary operation time that the transfer belt is circumferentially moved is lengthened to recover the contact trace on the transfer belt, and then, an image forming operation is performed, thereby to prevent a poor image (image noise) that occurs by the re-transfer due to the contact trace.

However, in the technology of Patent Literature 1, since the preliminary operation time is extended in order to recover the contact trace of the transfer belt, excessive standby time becomes needed and inconvenient to a user.

SUMMARY OF THE INVENTION

Therefore, it is a primary object of the present invention to provide a novel image forming apparatus, transfer current control method and storage medium.

It is another object of the present invention to provide an image forming apparatus, transfer current control method and storage medium, capable of preventing a poor image due to a contact trace that occurs on the transfer belt without extending preliminary operation time.

The present invention adopts the following structure in order to solve the above-described problem.

A first invention is an image forming apparatus in which a toner image formed on an image carrying member is transferred to a recording medium using a transfer belt that is stretched over a plurality of rollers to be circumferentially moved, comprising: a transfer roller that is rotatably provided and brought into pressure-contact to the transfer belt; a transfer power supply that applies a voltage to the transfer roller; a use situation measurement unit operable to measure a use situation of the transfer belt; and a transfer current control unit operable to control a transfer current that flows to the transfer roller by controlling the voltage applied from the transfer power supply to the transfer roller based on the use situation that is measured by the use situation measurement unit.

In the first invention, the image forming apparatus is an apparatus that transfers a toner image formed on the image carrying member to a recording medium using the transfer belt to form an image on the recording medium, and comprises the transfer belt that is stretched over the plurality of rollers to be circumferentially moved, the transfer roller that is rotated according to a circumferential movement of the transfer belt in a state where the transfer roller is brought into pressure-contact to the transfer belt, the transfer power supply that applies a voltage to the transfer roller, etc. Furthermore, the image forming apparatus comprises the use situation measurement unit and the transfer current control unit. The use situation measurement unit is operable to measure a use situation of the transfer belt, for example, non-use period showing a time period that an apparatus power supply is turned off, an environmental condition (temperature, humidity, etc.) around the transfer belt in the non-use period and a use period of the transfer belt (an elapse time period from manufacture date or use starting date to the present). The transfer current control unit is operable to controls the transfer current flowing into the transfer roller based on the use situation of the transfer belt by controlling the voltage that is applied to the transfer roller from the transfer power supply. In a situation that a contact trance occurs on the transfer belt, re-transfer of a toner due to the contact trace can be prevented by controlling the voltage that is applied to the transfer roller from the transfer power supply such that a current value of the transfer current is reduced.

According to the first invention, the transfer current that flows into the transfer roller is controlled based on the use situation of the transfer belt, and by performing control to reduce the current value of the transfer current in such a situation that the contact trace occurs on the transfer belt, re-transfer of a toner due to the contact trace can be prevented. Accordingly, it is possible to prevent, without extending preliminary operation time, a poor image due to the contact trace that occurs on the transfer belt.

A second invention is according to the first invention, wherein when a current value of the transfer current is changed from a standard value, the transfer current control unit is operable to control the voltage applied to the transfer roller such that the current value being changed of the transfer current is returned to the standard value after the transfer belt is circumferentially moved for a predetermined time period.

In the second invention, when a current value of the transfer current is changed from the standard value, the transfer current control unit determines that the contact trace that occurs on the transfer belt is recovered when a time period that the transfer belt is circumferentially moved reaches the predetermined time period (in other word, when reaching a predetermined number of printing sheets), and controls the voltage that is applied to the transfer roller such that the current value being changed of the transfer current is returned to the standard value, and performs image formation.

According to the second invention, since the current value being changed of the transfer current is returned to the standard value after the transfer belt is made to perform circumferential movement for the predetermined time period, it is possible to keep the number of sheets of the paper having possibility that an image quality of an output image is degraded due to change of the current value of the transfer current from the standard value at a limited number of sheets while preventing the poor image due to the contact trace of the transfer belt.

A third invention is according to the second invention, wherein the transfer current control unit is operable to control the voltage that is applied to the transfer roller such that the current value of the transfer current is gradually returned to the standard value when returning the current value being changed of the transfer current to the standard value.

In the third invention, since the contact trace of the transfer belt can be gradually recovered as the time of the circumferential movement increases, the transfer current control unit is operable to control the voltage that is applied to the transfer roller such that the current value of the transfer current is gradually returned to the standard value when returning the current value being changed of the transfer current to the standard value. That is, the transfer current control unit returns the current value of the transfer current to the standard value gradually according to a recovery state of the contact trace.

According to the third invention, it is possible to suppress degradation of the image quality of the output image resulting from change of the current value of the transfer current from the standard value while preventing the poor image due to the contact trace of the transfer belt more adequately.

A fourth invention is according to the first invention, wherein the image carrying member and the transfer roller are respectively arranged in plural number abreast in a movement direction of the transfer belt, and the transfer current control unit is operable to change only a voltage applied to the transfer roller that is arranged in a most downstream side in the movement direction of the transfer belt when changing the current value of the transfer current from the standard value.

In the fourth invention, a plurality of image carrying members and a plurality of transfer rollers are respectively arranged abreast in the movement direction of the transfer belt. In a situation that the contact trace occurs on the transfer belt, the transfer current control unit is operable to prevent the re-transfer of the toner due to the contact trace by controlling the voltage that is applied to the transfer roller from the transfer power supply such that only the current value of the transfer current that flows into the transfer roller arranged in the most downstream side in the movement direction of the transfer belt is reduced. Since the re-transfer of the toner is the easiest to occur in the image carrying member in the most downstream side in the movement direction of the transfer belt, the re-transfer of the toner can be effectively controlled by controlling adequately the transfer current that flows into the transfer roller arranged in the most downstream side.

According to the fourth invention, since only the transfer current that flows into the transfer roller in the most downstream side is changed and the current values of the transfer currents that flow into the transfer rollers in an upstream side are not changed, it is possible not only to effectively suppress the re-transfer of the toner but also to suppress degradation of the image quality of the output image resulting from change of the current value of the transfer current from the standard value.

A fifth invention is according to the first invention, wherein the image carrying member and the transfer roller are respectively arranged in plural number abreast in a movement direction of the transfer belt, and the transfer current control unit is operable to change the voltage applied to the transfer roller that is arranged in a downstream side in the movement direction of the transfer belt more greatly than the voltage that is applied to the transfer roller that is arranged in an upstream side in the movement direction of the transfer belt when changing the current value of the transfer current from the standard value.

In the fifth invention, a plurality of image carrying members and a plurality of transfer rollers are respectively arranged abreast in the movement direction of the transfer belt. In a situation that the contact trace occurs on the transfer belt, the transfer current control unit prevents the re-transfer of the toner due to the contact trace by controlling the voltage that is applied to the transfer roller from the transfer power supply such that a reduction range from the standard value of the transfer current that flows to the transfer roller in a downstream side in the movement direction of the transfer belt is made larger and a reduction range from the standard value of the transfer current that flows to the transfer roller in an upstream side is made smaller. Since the re-transfer of the toner becomes easy to occur as it becomes the image carrying member in the downstream side in the movement direction of the transfer belt, the re-transfer of the toner can be effectively controlled by more greatly reducing the transfer current that flows into the transfer roller in the downstream side rather than the transfer roller in the upstream side.

According to the fifth invention, since the reduction range of the transfer current that flows into the transfer roller in the downstream is made larger, it is possible not only to effectively suppress the re-transfer of the toner but also to suppress degradation of the image quality of the output image resulting from change of the current value of the transfer current from the standard value.

A sixth invention is according to the first invention, wherein a position that the transfer roller is brought into pressure-contact to the transfer belt is a position that is opposite to the image carrying member via the transfer belt and near the image carrying member, being shifted to the downstream side in the movement direction of the transfer belt than a position that the transfer belt and the image carrying member are brought into contact with each other.

In the sixth invention, the position (transfer current supply position) that the transfer roller is brought into pressure-contact to the transfer belt is a position slightly shifted to the downstream side in the movement direction (circumferential movement direction) of the transfer belt than the position (transfer position) that the transfer belt and the image carrying member are brought into contact to each other, that is, a position near the image carrying member. It is preferable that a distance between the transfer current supply position and the transfer position is set as 2-5 mm Although there is a tendency that a poor image due to the contact trace of the transfer belt becomes easy to occur when the distance between the transfer current supply position and the transfer position becomes large, it is possible to suppress the poor image due to the contact trace by setting the transfer current supply position and the transfer position in neighborhood position.

A seventh invention is a transfer current control method in an image forming apparatus, a processor of the image forming apparatus performing steps of: (a) measuring a use situation of a transfer belt; and (b) controlling a voltage that is applied from a transfer power supply to a transfer roller based on the use situation that is measured in the step (a) so as to control a transfer current that flows to the transfer roller.

An eighth invention is a storage medium storing a transfer current control program for an image forming apparatus, the transfer current control program causing a processor of the image forming apparatus to perform: measuring a use situation of a transfer belt; and controlling a voltage that is applied from a transfer power supply to a transfer roller based on the use situation so as to control a transfer current that flows to the transfer roller.

According to the seventh invention and the eighth invention, like the first invention, it is possible to prevent, without extending a preliminary operation time, a poor image due to a contact trace that is formed on the transfer belt.

The above mentioned objects and other objects, features, aspects and advantages of the present invention will become more apparent from the following detailed description of the present invention when taken in conjunction with the accompanying drawings.

DETAILED DESCRIPTION OF NON-LIMITING EXAMPLE EMBODIMENTS

First Embodiment

Figure 1:
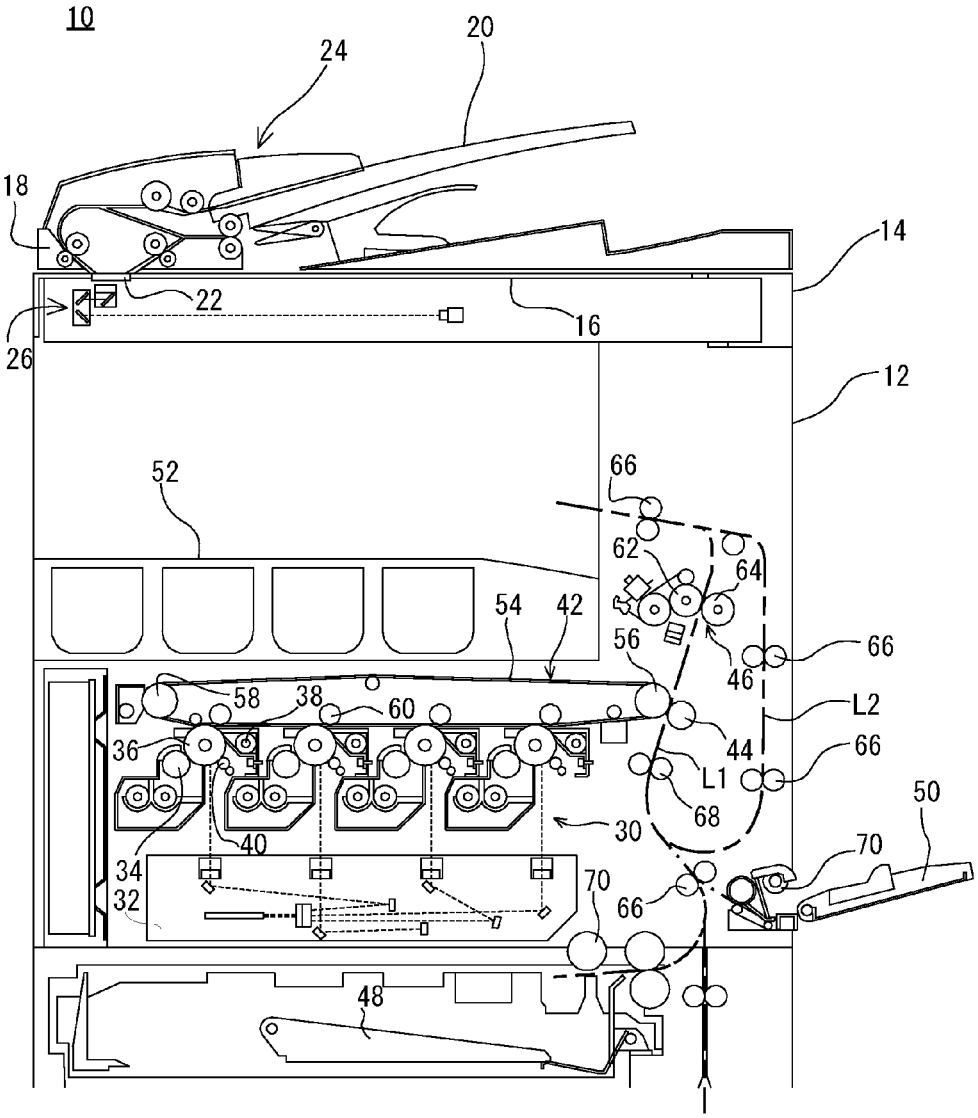
FIG. 1 is a schematic sectional view showing internal structure of an image forming apparatus that is a first embodiment according to the present invention.

With reference to FIG. 1, an image forming apparatus 10 that is an embodiment according to the present invention is a multifunction peripheral (MFP) that has a copy function, a printer function, a scanner function, a facsimile function, etc., and operates in a color printing mode or a monochrome printing mode to form a multicolor or monochromatic image on a paper (recording medium). As details will be described later, the image forming apparatus 10 comprises an image forming portion 30 of an intermediate transfer system, and transfers a toner image formed on a photoreceptor drum 36 to a paper using an intermediate transfer belt (primary transfer belt) 54 that is stretched over a plurality of rollers 56 and 58 to be circumferentially moved, etc.

Figure 2:
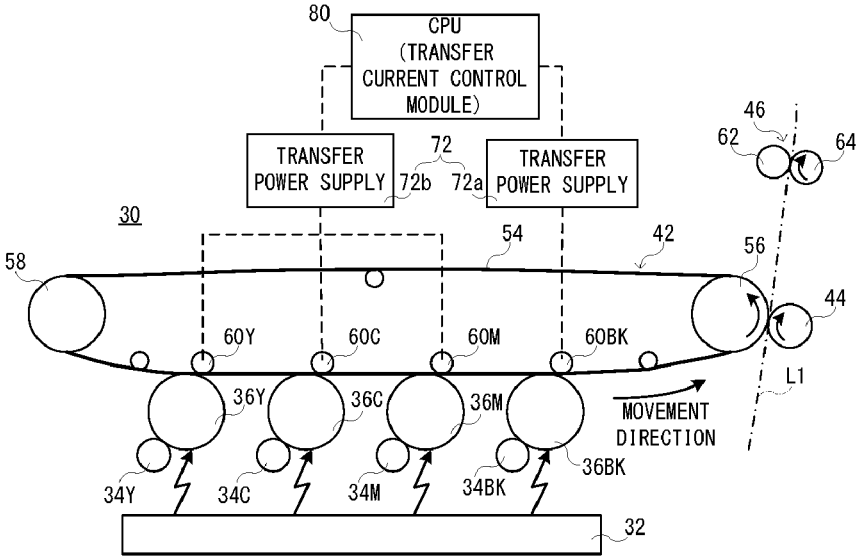
FIG. 2 is an illustration view schematically showing structure of an image forming portion that is provided in the image forming apparatus of FIG. 1.

First, basic structure of the image forming apparatus 10 will be described roughly. As shown in FIG. 1 and FIG. 2, the image forming apparatus 10 comprises a main body 12 that is provided with an image forming portion 30, etc., and an image reading apparatus 14 that is arranged above thereof.

The image reading apparatus 14 comprises an original platen 16 that is formed of transparent material. A platen cover 18 is attached above the original platen 16 via a hinge, etc. to be opened and closed freely. This platen cover 18 is provided with an ADF (Automatic Document Feeder) 24 that automatically feeds an original put on an original tray 20 one by one to an image reading position 22. Furthermore, an operating portion 28 (see FIG. 3) that receives an input operation by a user is provided at a front side of the original platen 16. The operating portion 28 includes a touch panel, operation buttons, a main switch for turning on/off an apparatus power supply of the image forming apparatus 10, etc.

Furthermore, the image reading apparatus 14 is provided with an image scanner 26 that comprises a light source, a plurality of mirrors, a focusing lens, a line sensor, etc. The image scanner 26 exposes a surface of an original by the light source, and leads a reflected light reflected from the original surface to the focusing lens by the plurality of mirrors. Then, the reflected light is focused to photoreceptor elements of the line sensor by the focusing lens. The line sensor detects brightness and chromaticity of the reflected light focused to the photoreceptor elements, and produces image data based on an image of the original surface. As the line sensor, a CCD (Charge Coupled Device), a CIS (Contact Image Sensor), etc. may be used.

The main body 12 is provided with a control portion comprising a CPU 80, a RAM 82 (see FIG. 3), etc., the image forming portion 30, etc. The control portion transmits control signals to respective components of the image forming apparatus 10 in response to the input operation to the operating portion 28 by a user, etc. to make the image forming apparatus 10 perform various kinds of operations or actions.

The image forming portion 30 comprises an exposure unit 32, a developing apparatus 34, a photoreceptor drum 36, a cleaning unit 38, a charger 40, an intermediate transfer belt unit 42, a secondary transfer roller 44, a fixing unit 46, etc., and an image is formed on a paper that is fed from a paper feeding tray 48 or a manual paper feeding tray 50, and a paper having been formed with the image is discharged to a paper discharge tray 52. As image data for forming an image on a paper, image data read by the image reading portion 26, image data transmitted from an external computer, etc. can be utilized.

Here, image data treated in the image forming apparatus 10 corresponds to a color image of four (4) colors of black (BK), magenta (M), cyan (C) and yellow (Y). Therefore, the developing apparatus 34, the photoreceptor drum 36, the cleaning unit 38 and the charger 40 are provided by four (4) respectively such that four kinds of latent images corresponding to respective colors can be formed, and four image stations are constituted by these components. The four image stations are arranged in a line along a travelling direction (circumferential movement direction) of a surface of an intermediate transfer belt 54, and the image stations for black, magenta, cyan and yellow are arranged in this order from a downstream side in the travelling direction of the surface of the intermediate transfer belt 54, that is, from a side close to the secondary transfer roller 44. However, an arrangement order of respective colors is changeable suitably.

In addition, subscripts BK, M, C and Y added to reference numerals are for indicating that each component is provided for which color, and the subscripts BK, M, C and Y show black, magenta, cyan and yellow, respectively. For example, a reference numeral 36BK in FIG. 2 shows that this component is a photoreceptor drum for black (for BK). Furthermore, in a description about respective components, if not required to distinguish the color of component particularly, the subscript BK, M, C or Y will be omitted so as to describe them generally.

The photoreceptor drum 36 is an image carrying member that a photosensitive layer is formed on a surface of a cylindrical substrate having conductivity. The charger 40 is a member of a roller type, brush type or the like for charging a surface of the photoreceptor drum 36 in a predetermined electric potential (−600V, for example). The exposure unit 32 is constructed as a laser scanning unit (LSU) that comprises a laser emitting portions and reflecting mirrors, etc., and exposes the surface of the photoreceptor drum 36 being charged to form an electrostatic latent image according to image data on the surface of the photoreceptor drum 36. The developing apparatus 34 visualizes the electrostatic latent image formed on the surface of the photoreceptor drum 36 with toners of four colors. Furthermore, the cleaner unit 38 removes the toner that remains on the surface of the photoreceptor drum 36 after development and image transfer, and transports the toner to a waste toner container (not shown).

The intermediate transfer belt unit 42 comprises an intermediate transfer belt 54, a driving roller 56, a driven roller 58, four (4) intermediate transfer rollers 60, etc., and is arranged above the photoreceptor drums 36.

The intermediate transfer belt 54 is an endless belt having flexibility, and formed of a synthetic resin such as polyimide (PI), polyamide (PA), polyvinylidene difluoride (PVDF), etc., rubber or the like that conductive material such as carbon black, etc. is combined therewith. The intermediate transfer belt 54 is stretched over a plurality of rollers such as the driving roller 56, driven roller 58, etc., and arranged such that an outer peripheral surface is brought into contact to the surface of the photoreceptor drums 36. Then, the intermediate transfer belt 54 is circumferentially moved in a predetermined direction (counterclockwise in FIG. 1 and FIG. 2) according to rotation drive of the driving roller 56.

Each of the intermediate transfer rollers (primary transfer rollers) 60 is a roller-shaped member that an elastic layer is laminated onto an outer peripheral surface of a core metal. The core metal of the intermediate transfer roller 60 is formed of metal such as stainless steel, aluminum, etc., and the elastic layer is formed of rubber such as ethylene-propylene rubber (EPDM), EPDM foam, urethane foam that conductive material such as carbon black, etc. is properly combined therewith. In addition, as the intermediate transfer roller 60, a metallic roller having no elastic layer on an outer peripheral surface may be used from viewpoints of cost reduction, miniaturization of apparatus, etc.

Each of the intermediate transfer rollers 60 is arranged in a position opposite to corresponding one of the photoreceptor drums 36 via the intermediate transfer belt 54, and is brought into pressure-contact to an inner circumferential surface of the intermediate transfer belt 54 to be rotated with circumferential movement of the intermediate transfer belt 54. Here, it is preferable that a position (transfer current supply position) that the intermediate transfer roller 60 is brought into pressure-contact to the intermediate transfer belt 54 is a position slightly shifted to a downstream side in the movement direction (circumferential movement direction) of the intermediate transfer belt 54 than a position (primary transfer position) that the intermediate transfer belt 54 and the photoreceptor drum 36 are brought into contact to each other, that is, near the photoreceptor drum 36. Specifically, it is preferable that a distance between the transfer current supply position and the primary transfer position in the movement direction of the intermediate transfer belt 54 is set as 2-5 mm. A reason is that in a case where a contact trace occurs on the intermediate transfer belt 54, it becomes easy to occur a poor image if the distance between the transfer current supply position and the primary transfer position becomes large. It is possible to suppress the poor image due to the contact trace by setting the transfer current supply position and the primary transfer position in neighborhood position.

However, the distance between the transfer current supply position and the primary transfer position in the movement direction of the intermediate transfer belt 54 is changeable suitably. For example, the intermediate transfer roller 60 and the photoreceptor drum 36 may be arranged so as to correspond to each other such that the distance between the transfer current supply position and the primary transfer position becomes 0 (zero) mm, that is, a line that connects a rotation axis of the photoreceptor drum 36 and a rotation axis of the intermediate transfer roller 60 and a line that is extended in the movement direction of the intermediate transfer belt 54 orthogonally intersect with each other. Furthermore, the intermediate transfer roller 60 and the photoreceptor drum 36 may be arranged so as to correspond to each other such that the distance between the transfer current supply position and the primary transfer position exceeds 5 mm.

A transfer power supply 72 and a transfer current detection portion 88 (see FIG. 3) are respectively connected to each of the intermediate transfer rollers 60. A transfer power supply 72 applies a voltage (primary transfer voltage) having a polarity reverse to a charged polarity of the toner that forms a toner image on the surface of the photoreceptor drum 36 to the intermediate transfer roller 60 according to instructions from the CPU 80 that functions, as described later, as a transfer current control unit. Accordingly, a current corresponding to the voltage applied from the transfer power supply 72 flows into the intermediate transfer roller 60 (primary transfer current is supplied). The transfer current detection portion 88 detects a current value of the current that flows into the intermediate transfer roller 60.

In this first embodiment, the transfer power supply 72*a* is connected to the intermediate transfer roller 60BK for black. The transfer power supply 72*a* applies a voltage that is constant-current-controlled to the intermediate transfer roller 60BK. More specifically, the voltage that is applied to the intermediate transfer roller 60BK from the transfer power supply 72*a* is changed such that the current that flows into the intermediate transfer roller 60BK becomes constant or approximately constant at a target current value, that is, a current value that is detected by the transfer current detection portion 88 and the target current value correspond to each other.

On the other hand, a transfer power supply 72*b* is connected in parallel to the intermediate transfer rollers 60M, 60C and 60Y for magenta, cyan and yellow. The transfer power supply 72*b* applies a voltage that is constant-voltage-controlled to each of the intermediate transfer rollers 60M, 60C and 60Y. That is, the transfer power supply 72*b* is controlled such that the voltage to be applied to the intermediate transfer rollers 60M, 60C and 60Y becomes a constant or approximately constant voltage value.

When the primary transfer current is supplied to the intermediate transfer roller 60, the primary transfer current flows into the intermediate transfer belt 54 through the transfer current supply position, and a transfer electric field is formed between the photoreceptor drum 36 and the intermediate transfer belt 54 in the primary transfer position. By an action of this transfer electric field that is formed in the primary transfer position, the toner image that is formed on the photoreceptor drum 36 is transferred (primary transfer) onto the outer peripheral surface of the intermediate transfer belt 54.

When forming a color image, for example, the toner images of respective colors formed on the photoreceptor drums 36 are transferred to the intermediate transfer belt 54 to be overlapped, and therefore, a multicolor toner image can be formed on the intermediate transfer belt 54. On the other hand, when forming a monochrome image, an electrostatic latent image and a toner image are formed on only the photoreceptor drum 36BK for black, and only the toner image of black is transferred on the outer peripheral surface of the intermediate transfer belt 54.

Furthermore, near the driving roller 56, a secondary transfer roller 44 is arranged. A transfer power supply not shown is connected to the secondary transfer roller 44, and a voltage (secondary transfer voltage) is applied by this transfer power supply. Then, by an action of a transfer electric field formed by the secondary transfer roller 44 being applied with the voltage, the toner image formed on the outer peripheral surface of the intermediate transfer belt 54 is transferred onto a paper (secondary transfer) during the paper passes through a transfer nip region between the intermediate transfer belt 54 and the secondary transfer roller 44.

The fixing unit 46 comprises a hot roller 62 and a pressure roller 64, and is arranged above the secondary transfer roller 44. The hot roller 62 is controlled to become a predetermined fixing temperature, and when a paper passes the fixing nip region between the hot roller 62 and the pressure roller 64, the toner image that is transferred to the paper is melted, mixed and pressured, whereby the toner image can be heat-fixed on the paper.

Within such a main body 12, a first paper feeding path L1 for feeding a paper that is put on a paper feeding tray 48 or a manual paper feeding tray 50 to a paper discharge tray 52 through a resist roller 68, the secondary transfer roller 44 and the fixing unit 46 is formed. Furthermore, there is formed with a second paper feeding path L2 for returning a paper after passing the fixing unit 46 while having completed simplex printing to the first paper path L1 in an upstream side of the paper feeding direction by the secondary transfer roller 44 when performing duplex printing to the paper. A plurality of feeding rollers 66 for feeding a paper are suitably provided in these first paper feeding path L1 and second feeding paper path L2.

When performing simplex printing in the main body 12, a paper put on the paper feeding tray 48 or the manual paper feeding tray 50 is led one by one to the first paper path L1 by a pickup roller 70, and fed by the feeding rollers 66 to the resist roller 68. Then, the paper is fed at a timing that a tip end of the paper and a tip end of the toner image on the intermediate transfer belt 54 are consistent with each other by the resist roller 68, whereby the toner image can be transferred on the paper. Thereafter, an unfixed toner on a paper is melted and fixed when the paper passes through the fixing unit 46, and the paper is discharged on the paper discharge tray 52 through the paper feeding rollers (paper discharge roller) 66.

On the other hand, if performing duplex printing, the paper is fed backward to be led to the second paper feeding path L2 by reversely rotating the paper discharge roller 66 when a tail end of the paper having been completed simplex printing passing through the fixing unit 46 reaches the paper discharge roller 66 near the paper discharge tray 52. The paper led to the second paper path L2 is fed in the second paper feeding path L2 by the paper feeding rollers 66, and is further led to the first paper path L1 in an upstream side of a paper feeding direction than the resist roller 68. Since the back and front of the paper is reversed at this time, when the paper passes the secondary transfer roller 44 and the fixing unit 46 after that, printing is performed on the back of a paper.

Figure 3:
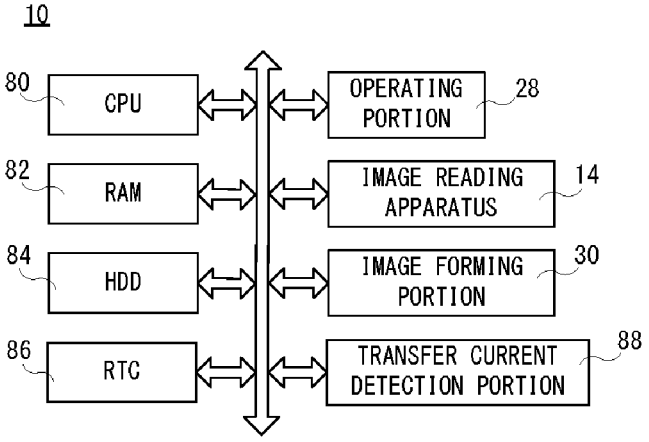
FIG. 3 is a block diagram showing an example of electric structure of the image forming apparatus of FIG. 1.

FIG. 3 is a block diagram showing an example of electric structure of the image forming apparatus 10. The image forming apparatus 10 includes a CPU 80. The CPU 80 is connected with a RAM 82, an HDD 84, an RTC 86, the operating portion 28, the image reading apparatus 14, the image forming portion 30, the transfer current detection portion 88, etc. Since the operating portion 28, the image reading apparatus 14, the image forming portion 30 and the transfer current detection portion 88 have been described above, a description thereof is omitted.

The CPU 80 is also called a processor or microcomputer, and controls operations of respective portions such as the image reading apparatus 14, the image forming portion 30, etc. of the image forming apparatus 10 in general.

The RAM 82 is used as a working memory and a buffer memory of the CPU 80. The HDD 84 is a main storage unit of the image forming apparatus 10, and stores suitably a control program, data, etc. for the CPU 80 to control operations of respective portions of the image forming apparatus 10. For example, in the HDD 84, information concerning a standard value of the primary transfer current that flows into each intermediate transfer roller 60 or a primary transfer voltage in a usual state where no contact trace occurs on the intermediate transfer belt 54 is stored. Furthermore, in the HDD 84, there are stored information concerning a use situation of the intermediate transfer belt 54, information concerning magnitude, change time, etc. of a current value of the primary transfer current that is adjusted corresponding to a predetermined condition when the use situation of the intermediate transfer belt 54 satisfies the predetermined condition, and information concerning the predetermined condition (threshold value, etc.), for example. In addition, instead of the HDD 84, a nonvolatile memory such as a flash memory may be used.

The RTC (Real Time Clock) 86 counts information of current date and time including a date and time, and outputs time information corresponding to the current date and time to the CPU 80 in response to a request from the CPU 80, for example. The RTC 86 is backed up by a battery not shown, and even if the apparatus power supply of the image forming apparatus 10 is turned off, it counts the time.

Furthermore, in this first embodiment, the CPU 80 functions as a use situation measurement unit that measures information concerning the use situation of the intermediate transfer belt 54, and stores measured information to the HDD 84 that functions as a use situation storage unit. For example, the CPU 80 detects a drive history of the intermediate transfer belt 54, that is, a start time, a suspension time (day, hour, minute, second), etc. when moving the intermediate transfer belt 54 circumferentially with reference to the RTC 86 as necessary, and stores them to the HDD 84.

In such an image forming apparatus 10, the CPU 80 also functions as a transfer current control unit, and controls the transfer current that flows into the intermediate transfer roller 60 by controlling the voltage to be applied to the intermediate transfer roller 60 from the transfer power supply 72. When forming an image, the CPU 80 prevents a poor image due to the contact trance (creep deformation) that occurs on the intermediate transfer belt 54 by controlling adequately the transfer current to be supplied to the intermediate transfer roller 60 based on the use situation of the intermediate transfer belt 54. In the following, a control method of the transfer current that is supplied to the intermediate transfer roller 60 will be specifically described.

The CPU 80, first, determines (guesses) whether the contact trace occurs on the intermediate transfer belt 54 by determining whether the use situation of the intermediate transfer belt 54 satisfies a predetermined condition.

Here, as main factors that make the contact trace occur on the intermediate transfer belt 54 in a contacting portion with a roller such as the driving roller 56, etc., it is possible to cite the use situation of the intermediate transfer belts 54 such as a non-use period showing a time period that the apparatus power supply of the image forming apparatus 10 is in a turned off state, an environmental condition around the intermediate transfer belt 54 in the non-use period (temperature, humidity, etc.), and a length of use period of the intermediate transfer belt 54 (an elapse time period from manufacture date or use starting date to the present).

Among them, the non-use period when the apparatus power supply is in the off state acts greatly as a factor that makes the contact trace occur on the intermediate transfer belt 54, and the contact trace becomes easy to occur as the non-use period becomes long. Therefore, in this first embodiment, when the non-use period is longer than a predetermined period (fourteen (14) days, for example), it is determined that the contact trace occurs on the intermediate transfer belt 54. In addition, the predetermined period that is a threshold value for determining whether the contact trace occurs can be suitably changed, and may be suitably set corresponding to material, a shape (curvature), and a pressure that is received from a roller such as driving roller 56, etc. of the intermediate transfer belt 54.

When the apparatus power supply is turned on, for example, the CPU 80 calculates, with reference to the HDD 84 and the RTC 86, an elapse time period from the latest suspension time (finish time of the printing performed at the end) of the intermediate transfer belt 54 before the apparatus power supply is turned off to the current time that the apparatus power supply is turned on as a non-use period approximately. Then, it is determined that the contact trace occurs on the intermediate transfer belt 54 if the non-use period that is calculated is equal to or more than 14 days, and if the non-use period is less than 14 days, it is determined that no contact trace occur on the intermediate transfer belt 54. Of course, by storing in the HDD 84 information of the day and time that the apparatus power supply is turned off, it is possible to calculate an elapse time period from the time that the apparatus power supply is turned off to the current time that the apparatus power supply is turned on again as a non-use period.

Then, if determining a usual state that the use situation of the intermediate transfer belt 54 does not satisfy the predetermined condition and thus no contact trace occur on the intermediate transfer belt 54, the CPU 80 controls the voltages to be applied to the intermediate transfer rollers 60 from the transfer power supplies 72*a* and 72*b* such that the current value of each transfer current that flows into each intermediate transfer roller 60 is rendered as a standard value.

Here, it is known that transfer efficiency of the toner image from the photoreceptor drum 36 to the intermediate transfer belt 54 is dependent on the transfer current. Therefore, the standard value of the transfer current that is supplied to the intermediate transfer roller 60 is made an optimal value that is evaluated through experiment, etc. such that it is possible to raise the transfer efficiency and to prevent a poor image such as a brush line, blur, etc. that occur due to shortage of a charge amount of the toner.

In this first embodiment, the standard value of the transfer current supplied to the intermediate transfer roller 60BK for black is +15 microamperes. When forming an image, the CPU 80 changes the voltage that is applied to the intermediate transfer roller 60BK from the transfer power supply 72*a* such that the current value that is detected by the transfer current detecting portion 84BK and the standard value correspond to each other. Furthermore, the standard value of the transfer current that is supplied to each of the intermediate transfer rollers 60M, 60C and 60Y for magenta, cyan and yellow is slightly smaller than that for the intermediate transfer roller 60BK, is +14 microamperes, for example. When forming an image, the CPU 80 controls the transfer power supply 72*b* to apply the constant voltage of +3000 V that is set for making the transfer current of this standard value flow to each of the intermediate transfer rollers 60M, 60C and 60Y.

On the other hand, when it is determined that the use situation of the intermediate transfer belt 54 satisfies the predetermined condition and thus the contact trace occurs on the intermediate transfer belt 54, the CPU 80 controls the voltages applied to the intermediate transfer roller 60 from the transfer power supplies 72*a* and 72*b* such that the current value of each transfer current that flows into each transfer roller 60 becomes lower than the standard value within a range that a poor image such as a brush line, etc. that occurs due to the shortage of the charge amount of the toner is inconspicuous as an image.

Here, in a state where the contact trace occurs on the intermediate transfer belt 54, in comparison with a usual state where no contact trace occur, a positional relationship (distance) between the intermediate transfer belt 54 and the photoreceptor drum 36 changes in a portion of the contact trace. Therefore, it becomes easy to re-transfer a part of the toner (toner image) that is transferred to the intermediate transfer belt 54 from the photoreceptor drum 36 in the primary transfer position to the photoreceptor drum 36, and a poor image occurs by this re-transfer. That is, in order to prevent a poor image due to the contact trace that occurs on the intermediate transfer belt 54, the re-transfer of the toner should be suppressed or prevented.

Furthermore, (A) When forming a color image, toner images are transferred to the intermediate transfer belt 54 to be overlapped sequentially from the photoreceptor drums 36 that is arranged in an upstream side in the movement direction of the intermediate transfer belt 54, that is, in an order of yellow, cyan, magenta and black. That is, since the toner transferred from the photoreceptor drum 36 in the upstream side becomes a layer (lower layer) near the outer peripheral surface of the intermediate transfer belt 54, an electrostatic adsorption force acts strongly to the intermediate transfer belt 54, and such the toner is hardly re-transferred to the photoreceptor drum 36. On the other hand, the toner transferred from the photoreceptor drum 36 in a downstream side becomes a layer (upper layer) apart from the outer peripheral surface of the intermediate transfer belt 54, not only an electrostatic adsorption force acting on the intermediate transfer belt 54 becomes weak but also a distance to the photoreceptor drum 36 becomes closer, and therefore, such the toner becomes easy to be re-transferred to the photoreceptor drum 36. (B) Furthermore, although it is thinkable that cause of the re-transfer of the toner is reverse charging of the toner, the toner that is transferred to the intermediate transfer belt 54 from the photoreceptor drum 36 in the upstream side in the movement direction of the intermediate transfer belt 54 becomes to have a larger charge amount (to obtain countercharge) with receiving the transfer current at every time that the toner passes through the primary transfer position (primary transfer nip) in the photoreceptor drum 36 in the downstream side. Therefore, the reverse charging hardly occurs and thus the re-transfer hardly occurs in the toner that is transferred from the photoreceptor drum 36 in the upstream side in comparison with the toner that is transferred from the photoreceptor drum 36 in the downstream side. (C) The standard value of the transfer current in the usual state is set such that the transfer current having the current value larger than those of the intermediate transfer rollers 60M, 60C and 60Y flows into the intermediate transfer roller 60BK for black in the most downstream side in the movement direction of the intermediate transfer belt 54 in order to increase the charge amount of the toner that is transferred from the photoreceptor drum 36 in the upstream side (to apply the countercharge) using this transfer current for black. Therefore, the re-transfer of the toner is easy to occur in the photoreceptor drum 36BK for black in the most downstream side than the photoreceptor drums 36M, 36C and 63Y in the upstream side.

Therefore, based on these knowledge (A)-(C), it is thinkable that in order to suppress the re-transfer of the toner, it is more effective to suitably control the transfer current that flows into the intermediate transfer roller 60 (reduce the current value) in the downstream side in the movement direction of the intermediate transfer belt 54 rather than the intermediate transfer roller 60 in the upstream side.

Furthermore, in the image forming portion 30, printing in a color printing mode or monochrome printing mode is possible. However, since the toner to be transferred to the intermediate transfer roller 60 is only one kind from photoreceptor drum 36BK for black in a case where a monochrome image is formed, in comparison to a case where a color image is formed, the re-transfer of the toner hardly occurs or even if the re-transfer occurs, it is hardly conspicuous as a poor image. That is, the poor image due to the contact trace that occurs on the intermediate transfer belt 54 is conspicuous when forming a color image.

Then, in this first embodiment, it is constructed that only the current value of the transfer current that flows into the intermediate transfer roller 60BK for black is changed when forming a color image in the situation the contact trace occurs on the intermediate transfer belt 54. That is, when the use situation of the intermediate transfer belt 54 satisfies the predetermined condition, the CPU 80 controls the voltage to be applied to intermediate transfer roller 60BK from the transfer power supply 72*a* such that the current value of the transfer current flowing into the intermediate transfer roller 60BK for black becomes lower than the standard value. By setting the current value of the transfer current lower than the standard value, the reverse charging of the toner that is transferred to the intermediate transfer belt 54 becomes difficult to occur, and therefore, the re-transfer of the toner from the intermediate transfer belt 54 to the photoreceptor drum 36 can be prevented.

In addition, since there is possibility that a poor image such as a brush line occurs due to shortage of the charge amount of the toner if reducing the current value of the transfer current than the standard value, it is preferable that a degree (change amount) of reduction of the current value of transfer current than the standard value is within a range that the poor image resulting from the shortage of the charge amount of the toner is not conspicuous as an image. That is, the degree of the reduction of the current value of transfer current than the standard value should be set within the range that the poor image by the re-transfer of the toner due to the contact trace becomes not conspicuous as an image, and within the poor image resulting from the shortage of the charge amount of the toner does not come to be conspicuous as an image.

According to a verification experiment by the inventors et al., it is confirmed that in the image forming apparatus that the standard value (optimal value) of the transfer current to be supplied to the intermediate transfer roller for black is set as +15 microamperes, by performing the control that the current value of the transfer current is set as between +13 and +11 microamperes, that is, the current value of the transfer current is reduced from the standard value by 2-4 microamperes, it is possible to suppress a poor image by the re-transfer of the toner due to the contact trace of the intermediate transfer belt as well as a poor image resulting from the shortage of the charge amount of the toner.

Then, in this first embodiment, in the situation that the contact trace occurs on the intermediate transfer belt 54, the CPU 80 performs image forming processing by controlling the voltage that is applied to the intermediate transfer roller 60BK from the transfer power supply 72*a* such that the current value of the transfer current that flows into the intermediate transfer roller 60BK is rendered as +12 microamperes that is lower than the standard value by 3 microamperes.

Furthermore, the contact trace that occurs on the intermediate transfer belt 54 is gradually canceled (recovered) as a time period for the intermediate transfer belt 54 to perform the circumferential movement increases, that is, as the number of sheets of the paper that the image forming is performed increases. According to a verification experiment by the inventors et al., it is confirmed that if a time period for the intermediate transfer belt 54 to perform circumferential movement elapses two (2) minutes at maximum, that is, if the image forming is performed on forty-five (45) sheets of paper in terms of the printing number of sheets of the paper, the contact trace that occurs on the intermediate transfer belt 54 is canceled completely.

Therefore, in this first embodiment, if the time period for the intermediate transfer belt 54 to perform the circumferential movement reaches a predetermined time period, that is, if the predetermined printing number of sheets is reached, it is determined that the contact trace that occurs on the intermediate transfer belt 54 is recovered, and the current value being changed of the transfer current is returned to the standard value and the image forming processing is performed. That is, the number of sheets of paper that the image forming is performed while changing the current value of the transfer current from the standard value is limited. Specifically, after the printing number of sheets reaches 45 sheets from the apparatus power supply is turned on, the CPU 80 controls the voltage that is applied to the intermediate transfer roller 60BK from the transfer power supply 72*a* such that the current value of the transfer current that flows into the intermediate transfer roller 60BK for black is rendered as +15 microamperes being the standard value, and performs the image forming processing.

Although the image quality of the image that is formed on the paper is degraded if changing the current value of the transfer current from the standard value that is set as the optimal value, by returning the current value of the transfer current to the standard value promptly after the contact trace of the intermediate transfer belt 54 is recovered, the number of sheets of the paper that an output image may decrease an image quality can be controlled.

In addition, the predetermined time period (the predetermined time period that the intermediate transfer belt 54 performs the circumferential movement) that is the threshold value for determining whether the contact trace is canceled can be changed suitably, and can be set according to material, a shape, and a pressure that is received from a roller such as driving roller 56, etc. of the intermediate transfer belt 54. Furthermore, in order to determine whether the intermediate transfer belt 54 performs the circumferential movement for the predetermined time period, instead of determining whether the predetermined printing number of sheets is reached, a time period that the intermediate transfer belt 54 actually performs the circumferential movement may be calculated with reference to the drive history (the start time and the suspension time of the circumferential movement, or the number of the circumferential movements), etc. of the intermediate transfer belt 54 stored in the HDD 84, etc.

Figure 4:
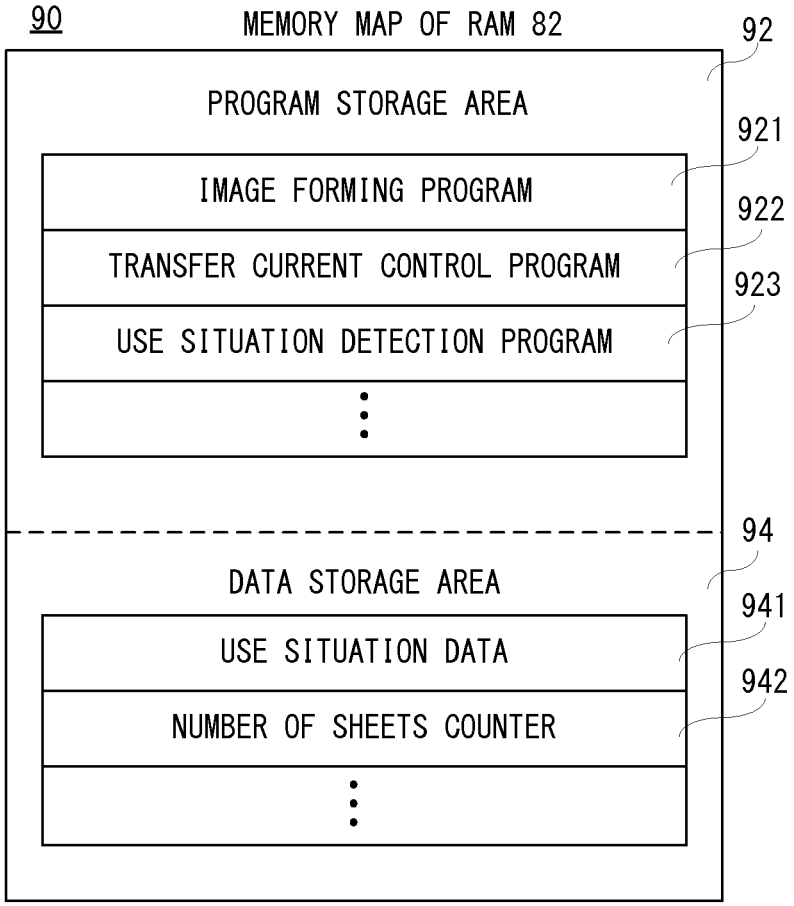
FIG. 4 is an illustration view showing a memory map of a RAM of the image forming apparatus of FIG. 1.

FIG. 4 shows a memory map 90 of the RAM 82 shown in FIG. 3. As shown in FIG. 4, the RAM 82 includes a program storage area 92 and a data storage area 94. The program store area 92 is stored with an image forming program 921, a transfer current control program 922, a use situation detection program 923, etc. The image forming program 921 is a program for forming a multicolor or monochromatic image on a paper based on image data that is read by the image reading portion 26, image data that is transmitted from an external computer, etc. The transfer current control program 922 is a program for controlling the current value of the transfer current that is to be supplied to the intermediate transfer roller 60 by controlling the transfer power supply 72*a* based on the use situation of the intermediate transfer belt 54 such that the current value of the transfer current that flows into intermediate transfer roller 60BK for black becomes lower than the standard value, etc. The use situation detection program 923 is a program for detecting a use situation of the intermediate transfer belt 54, including the non-use period that shows a time period that the apparatus power supply of the image forming apparatus 10 is in a turned off state, etc. In addition, the program storage area 92 is stored with programs for performing other functions such as a scanner function, a facsimile function, etc.

The data storage area 94 is stored with use situation data 941, and is provided with a number of sheets counter 942. The use situation data 941 is time data for calculating a non-uses period, and includes start time and suspension time when performing the circumferential movement of the intermediate transfer belt 54. In addition, in other embodiments, there is a case where environmental condition data such as temperature, humidity, etc. in the non-use period, and data of the use period of the intermediate transfer belt 54 are included. The number of sheets counter 942 is a counter for counting the printing number of sheets from the time that the apparatus power supply is turned on. In addition, although illustration is omitted, other data required for execution of the above-described program(s) is stored and a counter(s) and a flag(s) are provided in the data storage area 94.

Figure 5:
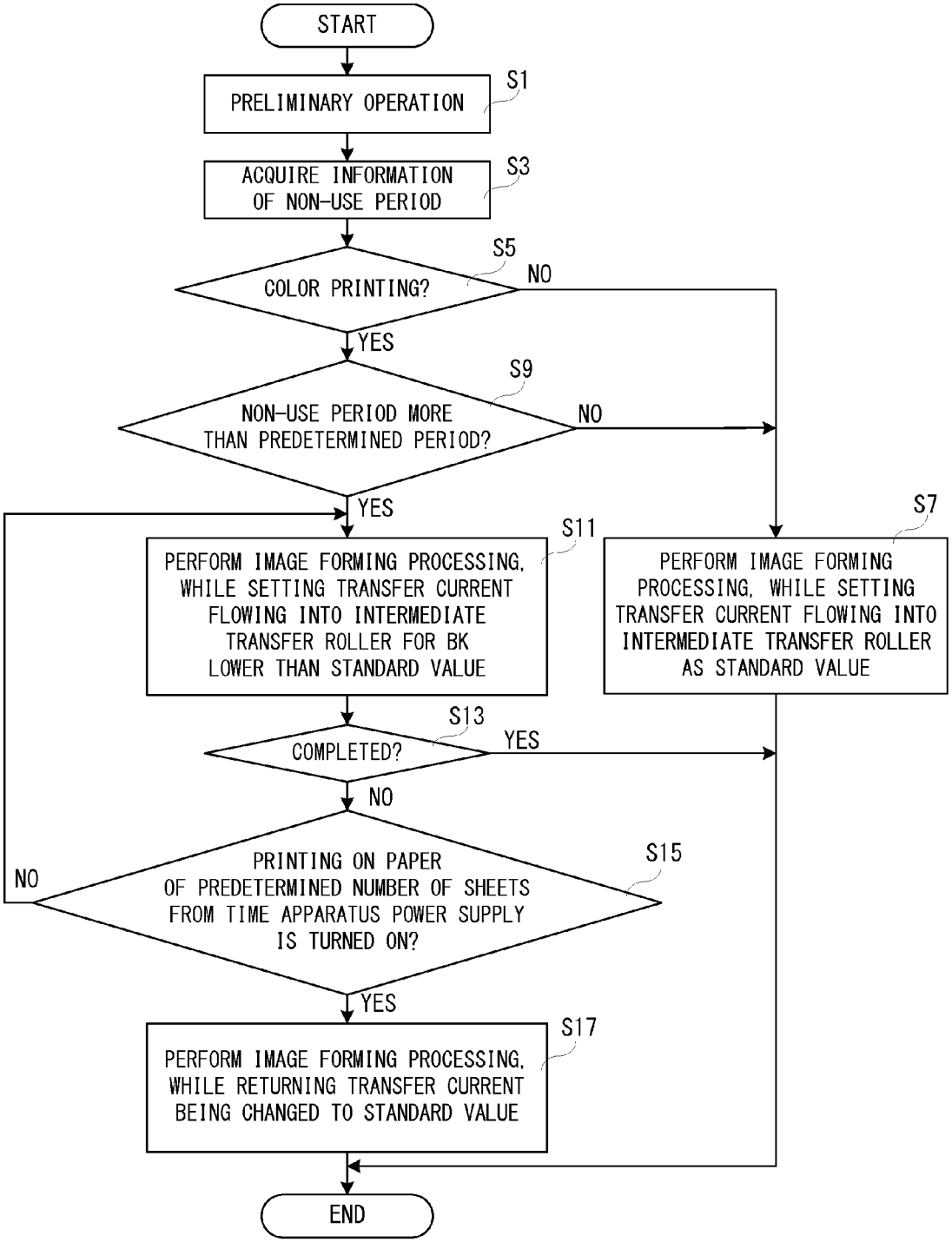
FIG. 5 is a flowchart showing an example of control processing by a CPU shown in FIG. 3.

FIG. 5 is a flowchart showing an example of entire processing in an image forming operation performed by the CPU 80 of the image forming apparatus 10. Here, control processing of the primary transfer current based on the use situation of the intermediate transfer belt 54 will be described mainly.

As shown in FIG. 5, if the apparatus power supply of the image forming apparatus 10 is turned on, the CPU 80 performs preliminary operation processing in a step S1. More specifically, as stabilization control for rendering the image forming apparatus 10 in a state where printing can be performed, the CPU 80 makes respective components including the intermediate transfer belt 54 of the image forming apparatus 10 perform the preliminary operation (warm-up) only for a predetermined time period.

In a next step S3, information of a non-use period is acquired. That is, the CPU 80 acquires information concerning the non-use period showing a time period that the apparatus power supply of the image forming apparatus 10 is in an off state. For example, the CPU 80 approximately calculates, with reference to the HDD 84 and the RTC 86, an elapse time period from the latest suspension time of the intermediate transfer belt 54 before the apparatus power supply is turned off to the current time that the apparatus power supply is turned on as the non-use period.

In a next step S5, it is determined whether color printing is to be performed. That is, the CPU 80 determines a printing instruction that is input to the operating portion 28 by the user is a color printing instruction or a monochrome printing instruction.

If "NO" is determined in the step S5, that is, if the monochrome printing instruction is input, the process proceeds to a step S7, wherein the current value of the transfer current that flows into the intermediate transfer roller 60 is set as the standard value and performs the image forming processing. More specifically, the CPU 80 controls the voltage to be applied to the intermediate transfer roller 60 from the transfer power supply 72 such that the transfer current of the standard value flows into the intermediate transfer roller 60 as usual when transferring (primary transfer) the toner image formed on the photoreceptor drum 36 to the outer peripheral surface of the intermediate transfer belt 54, and performs the image forming processing (a series of processes including a charging process, an exposure process, a developing process, a transfer process, a fixing process, etc.) to form a monochrome image on a paper. In addition, the CPU 80 measures the number of sheets of the paper that the image is formed using the number of sheets counter to store in the HDD 84, etc. Then, when the image forming to the number of sheets of the paper directed by the user is completed, this entire processing is terminated with no operation.

On the other hand, if "YES" is determined in the step S5, that is, if the color printing instruction is input, it is determined whether the non-use period is equal to or more than the predetermined time period in a step S9. That is, the CPU 80 determines whether the non-use period acquired in the step S3 is equal to or more than the predetermined time period (14 days, for example) that is set in advance.

If "NO" is determined in the step S9, that is, if determining that a state is the usual state where the non-use period is less than 14 days and no contact trace occurs on the intermediate transfer belt 54, the process proceeds to a step S7, like the case of a monochrome printing, the current value of the transfer current that flows into the intermediate transfer roller 60 is set as the standard value, and the image forming processing to form a color image on a paper is performed.

On the other hand, if "YES" is determined in the step S9, that is, if it is determined that the non-use period is equal to or more than 14 days and thus the contact trace occurs on the intermediate transfer belt 54, in a step S11, the current value of the transfer current that flows into intermediate transfer roller 60BK for black is set lower than the standard value, and the image forming processing is performed. More specifically, the CPU 80 controls the voltage that is applied to the intermediate transfer roller 60BK from the transfer power supply 72*a* such that the transfer current lower than the standard value flows into the intermediate transfer roller 60BK for black when the toner image formed on the photoreceptor drum 36 is to be transferred to the outer peripheral surface of the intermediate transfer belt 54, and performs the image forming processing to form a color image on a paper. In this first embodiment, specifically, the CPU 80 controls the transfer power supply 72*a* such that the transfer current of +12 microamperes that is lower than the standard value of +15 microamperes by 3 microamperes flows. In addition, the CPU 80 controls the transfer power supply 72*b* such that the transfer current of the standard value flows into each of the intermediate transfer rollers 60M, 60C and 60Y other than for black.

In a subsequent step S13, it is determined whether the image forming to the paper of the printing number of sheets directed by the user is completed. If "YES" is determined in the step S13, that is, the image forming to the paper of the printing number of sheets directed by the user is completed, this entire processing is terminated with no operation. On the other hand, if "NO" is determined in the step S13, that is, the image forming to the paper of the printing number of sheets directed by the user still remains, the process proceeds to a step S15.

In the step S15, it is determined whether the printing to the paper of the predetermined number of sheets from the time that the apparatus power supply is turned on is reached. That is, the CPU 80 determines whether the printing number of sheets from the time that the apparatus power supply is turned on reaches the predetermined number of sheets (45 sheets, for example), that is, determines whether the intermediate transfer belt 54 sufficiently performs the circumferential movement and thus the contact trace of the intermediate transfer belt 54 is recovered.

If "NO" is determined in the step S15, that is, if not printing to the paper of predetermined number of sheets from the time that the apparatus power supply is turned on, the process returns to the step S11 to continue the image forming processing in the state where the current value of the transfer current that flows into intermediate transfer roller 60BK for black is set to be lower than the standard value.

On the other hand, if "YES" is determined in the step S15, that is, the printing number of sheets from the time that the apparatus power supply is turned on reaches the predetermined number of sheets and thus the contact trace of the intermediate transfer belt 54 is recovered, the process proceeds to a step S17.

In the step S17, the image forming processing is performed after the current value being changed of the transfer current flowing into the intermediate transfer roller 60BK for black is returned to the standard value. More specifically, when transferring the toner image that is formed on the photoreceptor drum 36 to the outer peripheral surface of the intermediate transfer belt 54, the CPU 80 controls the voltage that is applied to the intermediate transfer roller 60BK from the transfer power supply 72*a* such that the transfer current of the standard value (+15 microamperes) flows into the intermediate transfer roller 60BK for black, and performs the image forming processing to form a color image to a paper. Then, the CPU 80 terminates this entire processing after the image forming to the paper of the printing number of sheets directed by the user is completed.

In addition, when another printing instruction is input from a user after a series of operations shown in FIG. 5 is completed without turning off the apparatus power supply, the processing after the step S5 should be performed after performing the preliminary operation processing as required. Then, if it is determined as "YES" in the step S15 once, thereafter, the image forming processing that the transfer current is set as the standard value should be performed as usual without performing the control processing of the transfer current based on the use situation of the intermediate transfer belt 54 as shown in FIG. 5 until the apparatus power supply is turned off again because it is possible to determine that the contact trace of the intermediate transfer belt 54 is recovered.

According to this first embodiment, the re-transfer of the toner due to the contact trace can be prevented by controlling the transfer current that flows into the intermediate transfer roller 60 based on the use situation of the intermediate transfer belt 54 to perform the control reducing the current value of the transfer current in a situation that a contact trace occurs on the intermediate transfer belt 54. Therefore, the poor image due to the contact trace that occurs on the intermediate transfer belt 54 is prevented without extending the preliminary operation time of the intermediate transfer belt 54.

Furthermore, according to the first embodiment, since the preliminary operation time of the intermediate transfer belt 54 is not extended in order to cancel the contact trace, it is possible to prolong the life of the intermediate transfer belt unit 42 including the intermediate transfer belt 54 without exhausting too much the intermediate transfer belt unit 42.

Furthermore, according to the first embodiment, since the current value being changed of the transfer current is returned to the standard value after performing the intermediate transfer belt 54 the circumferential movement for the predetermined time period, it is possible to keep the number of sheets of the paper having possibility that an image quality of an output image is degraded resulting from the change of the current value of the transfer current from the standard value at the restricted number of sheets while preventing the poor image due to the contact trace of the intermediate transfer belt 54.

Furthermore, according to the first embodiment, only the transfer current that flows to the intermediate transfer roller 60BK for black is changed and the current values of the transfer currents that flow into the transfer rollers 60M, 60C and 60Y are not changed, it is possible not only to effectively suppress the re-transfer of the toner but also to suppress degradation of the image quality of the output image resulting from the change of the current value of the transfer current from the standard value.

Second Embodiment

Next, with reference to FIG. 6, an image forming apparatus 10 that is the second embodiment according to the present invention will be described. This second embodiment is different from the above-described first embodiment in a point that a reduction range of the transfer current to be supplied to the intermediate transfer roller 60BK is made larger as the non-use period showing a time period that the apparatus power supply of the image forming apparatus 10 is in an off state becomes longer. Since other portions are the same as those of the above-described first embodiment, a duplicate description is omitted or simplified, and an example of entire processing of an image forming operation the CPU 80 performs will be described here using a flowchart.

Figure 6:
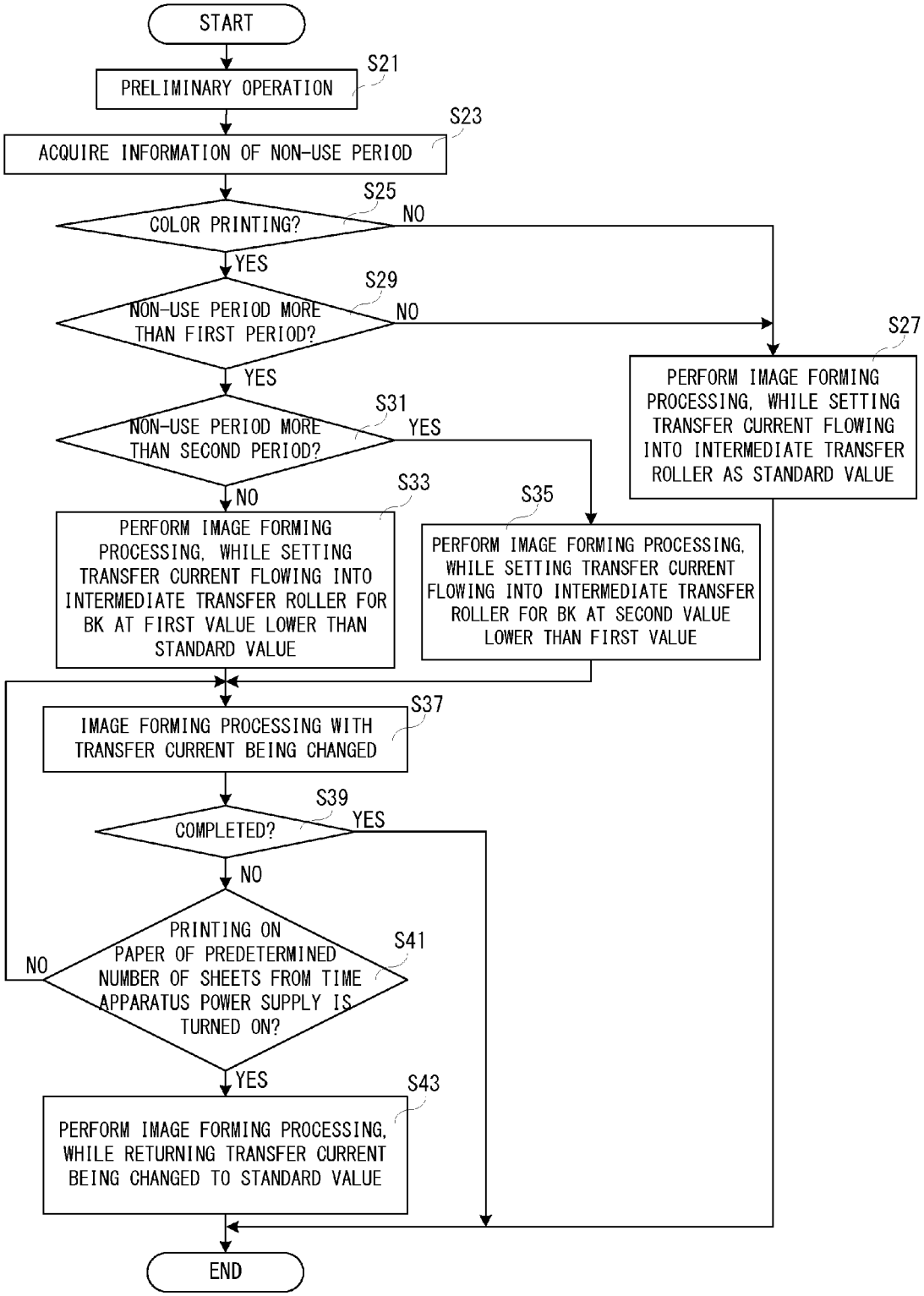
FIG. 6 is a flowchart showing an example of control processing by a CPU of an image forming apparatus that is a second embodiment according to the present invention.

As shown in FIG. 6, when the apparatus power supply of the image forming apparatus 10 is turned on, the CPU 80 performs preliminary operation processing in a step S21. In a next step S23, information of the non-use period is acquired.

Subsequently, in a step S25, it is determined whether color printing is to be performed. If "NO" is determined in the step S25, that is, if a monochrome printing instruction is input, the process proceeds to a step S27, and the image forming processing is performed after the current value of the transfer current that flows into the intermediate transfer roller 60 is set as the standard value. On the other hand, if "YES" is determined in the step S25, that is, if a color printing instruction is input, the process proceeds to a step S29.

In the step S29, it is determined whether the non-use period is equal to or more than the first period. That is, the CPU 80 determines whether the non-use period acquired in the step S23 is equal to or more than the predetermined first period (10 days, for example) that is set in advance.

If "NO" is determined in the step S29, that is, if it is determined that a state is the usual state where the non-use period is less than 10 days and thus no contact trace occurs on the intermediate transfer belt 54, the process proceeds to a step S27 wherein the current value of the transfer current that flows into the intermediate transfer roller 60 is set as the standard value, and the image forming processing to a paper is performed.

On the other hand, if "YES" is determined in the step S29, that is, if it is determined that the non-use period is equal to or more than 10 days and the contact trace occurs on the intermediate transfer belt 54, the process proceeds to a step S31.

In the step S31, it is further determined whether the non-use period is equal to or more than a second period. That is, the CPU 80 determines whether the non-use period acquired in the step S23 is equal to or more than the second period (20 days, for example) set in advance to be longer than the first period. Since the degree (size) of the contact trace that occurs on the intermediate transfer belt 54 becomes large as the non-use period becomes long, the degree of the contact trace is determined (presumed) based on the length of the non-use period.

If "NO" is determined in the step S31, that is, if it is determined that the non-use period is equal to or more than the first period and less than the second period and thus the degree of the contact trace that occurs on the intermediate transfer belt 54 is relatively small, the process proceeds to a step S33. In the step S33, the current value of the transfer current that flows into the intermediate transfer roller 60BK for black is set as the first value lower than the standard value, and the process proceeds to a step S37. The CPU 80 changes the setting such that the transfer current of +13 microamperes lower than +15 microamperes of the standard value by 2 microamperes flows into the intermediate transfer roller 60BK, for example.

If "YES" is determined in the step S31, that is, if it is determined that the non-use period is equal to or more than the second period and thus the degree of the contact trace that occurs on the intermediate transfer belt 54 is relatively large, the process proceeds to a step S35. In the step S35, the current value of the transfer current that flows into the intermediate transfer roller 60BK for black is set as the second value lower than the first value, and the process proceeds to a step S37. The CPU 80 changes the setting such that the transfer current of +12 microamperes further lower than +13 microamperes of the first value by 1 microampere flows into intermediate transfer roller 60BK, for example.

In the step S37, the image forming processing is performed with the transfer current being changed. More specifically, the CPU 80 controls the voltage that is applied to the intermediate transfer roller 60BK from the transfer power supply 72*a* such that the transfer current that is set in the step S33 or S35 flows into the intermediate transfer roller 60BK for black when the toner image formed on the photoreceptor drum 36 is to be transferred to the outer peripheral surface of the intermediate transfer belt 54, and performs the image forming processing to form a color image on a paper.

In a subsequent step S39, it is determined whether the image forming to the paper of the printing number of sheets directed by the user is completed. If "YES" is determined in the step S39, that is, the image forming to the paper of the printing number of sheets directed by the user is completed, this entire processing is terminated with no operation. On the other hand, if "NO" is determined in the step S39, that is, the image forming on the paper of the printing number of sheets directed by the user still remains, the process proceeds to a step S41.

In step S41, it is determined whether the printing on the paper of the predetermined number of sheets from the time that the apparatus power supply is turned on is reached. That is, the CPU 80 determines whether the printing number of sheets from the time that the apparatus power supply is turned on reaches the predetermined number of sheets (45 sheets, for example).

If "NO" is determined in the step S41, that is, if not printing on the paper of the predetermined number of sheets from the time that the apparatus power supply is turned on, the process returns to the step S37. On the other hand, if "YES" is determined in the step S41, that is, the printing number of sheets from the time that the apparatus power supply is turned on reaches the predetermined number of sheets and thus the contact trace of the intermediate transfer belt 54 is recovered, the process proceeds to a step S43.

In the step S43, the image forming processing is performed after the current value of the transfer current flowing into the intermediate transfer roller 60BK for black is returned to the standard value. Then, the CPU 80 terminates this entire processing after the image forming to the paper of the printing number of sheets directed by the user is completed.

According to this second embodiment, like the first embodiment, the re-transfer of the toner is prevented by controlling the transfer current that flows into the intermediate transfer roller 60 based on the use situation of the intermediate transfer belt 54. Therefore, the poor image due to the contact trace that occurs on the intermediate transfer belt 54 can be prevented without extending the preliminary operation time of the intermediate transfer belt 54.

Furthermore, according to the second embodiment, since the reduction range of the transfer current to be supplied to the intermediate transfer roller 60BK is made large as the non-use period becomes long, it is possible to more adequately prevent the re-transfer of the toner and to prevent more adequately the poor image due to the contact trace that occurs on the intermediate transfer belt 54. More specifically, the degree of the contact trace that occurs on the intermediate transfer belt 54 becomes large as the non-use period that shows the time period that the apparatus power supply of the image forming apparatus 10 is in an off state becomes long, and therefore, the toner becomes easy to re-transfer to the photoreceptor drum 36 from the intermediate transfer belt 54; however, by setting the reduction range of the transfer current to be supplied to the intermediate transfer roller 60BK large as the non-use period becomes long, it is possible to surely prevent the re-transfer of the toner.

In addition, although the reduction range is changed to be divided into two stages of the first period and the second period, in the above-described second embodiment, the reduction range of the transfer current may be changed to be divided three or more stages.

Third Embodiment

Subsequently, with reference to FIG. 7, an image forming apparatus 10 that is the third embodiment according to the present invention will be described. This third embodiment is different from the above-described first embodiment and the second embodiment, in a point that a time period that until a current value being changed of the transfer current is returned to the standard value is lengthened as the non-use period that shows the time period that the apparatus power supply of the image forming apparatus 10 is in an off state becomes long. Since other portions are the same as those of the above-described first embodiment and second embodiment, a duplicate description is omitted or simplified, and an example of entire processing of an image forming operation the CPU 80 performs will be described here using a flowchart.

Figure 7:
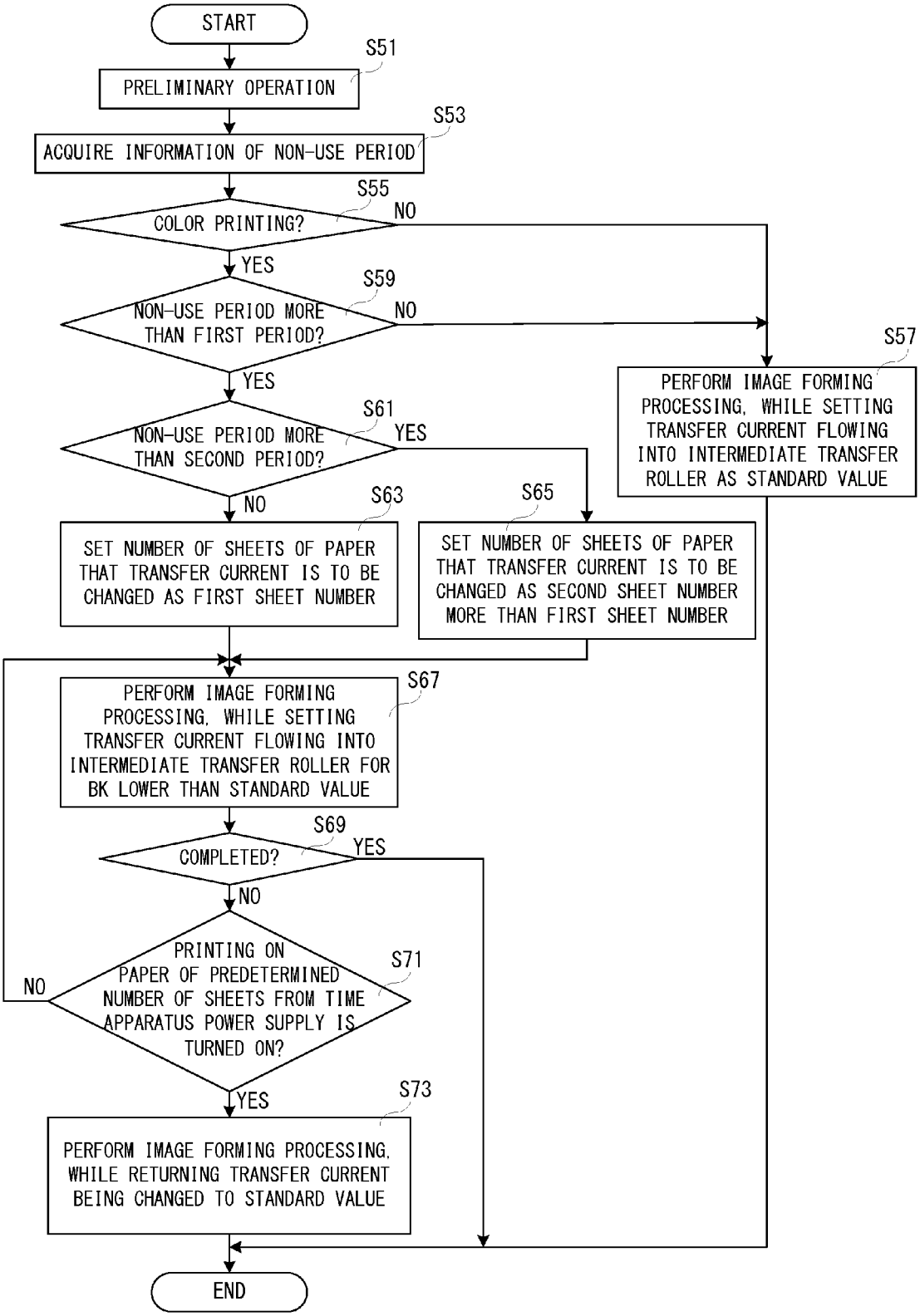
FIG. 7 is a flowchart showing an example of control processing by a CPU of an image forming apparatus that is a third embodiment according to the present invention.

As shown in FIG. 7, when the apparatus power supply of the image forming apparatus 10 is turned on, the CPU 80 performs preliminary operation processing in a step S51. In a next step S53, information of the non-use period is acquired.

Subsequently, in a step S55, it is determined whether color printing is to be performed. If "NO" is determined in the step S55, that is, if a monochrome printing instruction is input, the process proceeds to a step S57 wherein the image forming processing is performed after the current value of the transfer current that flows into the intermediate transfer roller 60 is set as the standard value. On the other hand, if "YES" is determined in the step S55, that is, if a color printing instruction is input, the process proceeds to a step S59.

In the step S59, it is determined whether the non-use period is equal to or more than the first period. That is, the CPU 80 determines whether the non-use period acquired in the step S53 is equal to or more than the first period (10 days, for example) that is set in advance.

If "NO" is determined in the step S59, that is, if the non-use period is less than the first period, the process proceeds to a step S57 wherein the current value of the transfer current that flows into the intermediate transfer roller 60 is set as the standard value, and the image forming processing to a paper is performed. On the other hand, if "YES" is determined in the step S59, that is, if it is determined that the non-use period is equal to or more than the first period, the process proceeds to a step S61.

In the step S61, it is further determined whether the non-use period is equal to or more than a second period. That is, the CPU 80 determines whether the non-use period acquired in the step S53 is equal to or more than the second period (20 days, for example) set in advance to be longer than the first period.

If "NO" is determined in the step S61, that is, if it is determined that the non-use period is equal to or more than the first period and less than the second period and thus the degree of the contact trace that occurs on the intermediate transfer belt 54 is relatively small, the process proceeds to a step S63. In the step S63, it is set the predetermined number of sheets of a paper that the transfer current is to be changed as the relatively smaller first sheet number (25 sheets, for example). That is, the CPU 80 sets relatively shorter the predetermined time that the intermediate transfer belt 54 is circumferentially moved until the current value being changed of the transfer current is returned to the standard value, and proceeds to a step S67.

On the other hand, if "YES" is determined in the step S61, that is, if it is determined that the non-use period is equal to or more than the second period and thus the degree of the contact trace that occurs on the intermediate transfer belt 54 is relatively large, the process proceeds to a step S65. In the step S65, it is set the predetermined number of sheets of a paper that the current value of the transfer current is to be changed as second sheet number (45 sheets, for example) larger than the first sheet number. That is, the CPU 80 sets relatively longer the predetermined time that the intermediate transfer belt 54 is circumferentially moved until the current value being changed of the transfer current is returned to the standard value, and proceeds to a step S67.

In the step S67, the current value of the transfer current that flows into the intermediate transfer roller 60BK for black is set to be lower than the standard value, and the image forming processing is performed. More specifically, the CPU 80 controls the voltage that is applied to the intermediate transfer roller 60BK from the transfer power supply 72*a* such that the transfer current lower than the standard value flows into the intermediate transfer roller 60BK for black when the toner image formed on the photoreceptor drum 36 is to be transferred to the outer peripheral surface of the intermediate transfer belt 54, and performs the image forming processing to form a color image on a paper. The transfer power supply 72*a* is controlled such that the transfer current of +12 microamperes that is lower than +15 microamperes of the standard value by 3 microamperes flows, for example.

In a subsequent step S69, it is determined whether the image forming to the paper of the printing number of sheets directed by the user is completed. If "YES" is determined in the step S69, that is, the image forming to the paper of the printing number of sheets directed by the user is completed, this entire processing is terminated with no operation. On the other hand, if "NO" is determined in the step S69, that is, the image forming on the paper of the printing number of sheets directed by the user still remains, the process proceeds to a step S71.

In the step S71, it is determined whether the printing on the paper of the predetermined number of sheets from the time that the apparatus power supply is turned on is reached. That is, the CPU 80 determines whether the printing number of sheets from the time that the apparatus power supply is turned on reaches the predetermined number of sheets set in the step S63 or the step S65.

If "NO" is determined in the step S71, that is, if not printing on the paper of predetermined number of sheets from the time that the apparatus power supply is turned on, the process returns to the step S67. On the other hand, if "YES" is determined in the step S71, that is, if the printing number of sheets from the time that the apparatus power supply is turned on reaches the predetermined number of sheets, the process proceeds to a step S73.

In the step S73, the image forming processing is performed after the current value of the transfer current flowing into the intermediate transfer roller 60BK for black is returned to the standard value. Then, the CPU 80 terminates this entire processing after the image forming to the paper of the printing number of sheets directed by the user is completed.

According to this third embodiment, like the first embodiment, the re-transfer of the toner can be prevented by controlling the transfer current that flows into the intermediate transfer roller 60 based on the use situation of the intermediate transfer belt 54. Therefore, it is possible to prevent the poor image due to the contact trace that occurs on the intermediate transfer belt 54 without extending the preliminary operation time of the intermediate transfer belt 54.

Furthermore, according to the third embodiment, since the time period until the current value being changed of the transfer current is returned to the standard value is lengthened as the non-use period becomes long, it is possible to more adequately prevent the re-transfer of the toner and prevent more adequately the poor image due to the contact trace that occurs on the intermediate transfer belt 54. That is, although time is taken to recover the contact trace because the degree of the contact trace that occurs on the intermediate transfer belt 54 becomes large as the non-use period that shows the time period that the apparatus power supply of the image forming apparatus 10 is in an off state becomes long, by lengthening a time period until the current value being changed of the transfer current is returned to the standard value as the non-use period becomes long, the re-transfer of the toner can be surely prevented.

In addition, although the time period until the current value being changed of the transfer current is returned to the standard value (increase the print number of sheets) is changed to be divided into two stages of the first time period and the second time period in the above-described third embodiment, the time period until the current value being changed of the transfer current is returned to the standard value may be changed to be divided three or more stages. Furthermore, it is possible to increase the reduction range of the transfer current that is supplied to the intermediate transfer roller 60BK and to lengthen a time period until the current value being changed of the transfer current is returned to the standard value as the non-use period becomes long.

Furthermore, although the non-use period that shows the time period that the apparatus power supply of the image forming apparatus 10 is in an off state is used as the information concerning the use situation of the intermediate transfer belt 54 for determining whether the contact trace occurs on the intermediate transfer belt 54 in the above-described first-third embodiments, not limited to this. As the information concerning the use situation of the intermediate transfer belt 54, instead of the non-use period or in addition to the non-use period, an environmental condition around the intermediate transfer belt 54 in the non-use period, the use period of the intermediate transfer belt 54, etc. may be used.

If using temperature around the intermediate transfer belt 54 in the non-use period as the information concerning the use situation of the intermediate transfer belt 54, for example, a temperature sensor is provided around the intermediate transfer belt 54. The CPU 80 detects an output of the temperature sensor to measure periodically ambient temperature of the intermediate transfer belt 54 in the non-use period. However, at least one of the temperature when turning off the apparatus power supply and the temperature when turning on thereof should be measured, and the one of the temperature or an average value may be used as an approximate value of the ambient temperature of the intermediate transfer belt 54. Information of measured temperature is suitably stored in the HDD 84, etc. Since it becomes easy to occur a contact trace if the ambient temperature of the intermediate transfer belt 54 in the non-use period becomes high, if the ambient temperature of the intermediate transfer belt 54 in the non-use period is higher than predetermined temperature (28° C., for example), it should be determined that a contact trace occurs on the intermediate transfer belt 54 or that the degree of the contact trace is large. In addition, it is possible to use humidity information instead of or in addition to the temperature information because it becomes easy to occur the contact trace if humidity is high.

Furthermore, as the information concerning the use situation of the intermediate transfer belt 54, if using the use period of the intermediate transfer belt 54, for example, the CPU 80 measures, with reference to the RCT 86, an elapse time period from manufacture date or use starting date of the intermediate transfer belt 54 to the present. Measured the use period information is suitably stored in the HDD 84, etc. Since it becomes easy to occur a contact trace if the use period of the intermediate transfer belt 54 become long, if the use period are longer than a predetermined period (1 year, for example), it should be determined that the contact trace occurs on the intermediate transfer belt 54 or that the degree of the contact trace is large.

Fourth Embodiment

Subsequently, with reference to FIG. 8, an image forming apparatus 10 that is the fourth embodiment according to the present invention will be described. The fourth embodiment is different from the above-described first-third embodiments in a point that the transfer current that flows into the intermediate transfer roller 60BK is controlled based on the non-use period that shows the time period that the apparatus power supply of the image forming apparatus 10 is in an off state and the temperature in this non-use period. Since other portions are the same as those of the above-described first-third embodiments, a duplicate description is omitted or simplified, and an example of entire processing of an image forming operation the CPU 80 performs will be described here using a flowchart.

Figure 8:
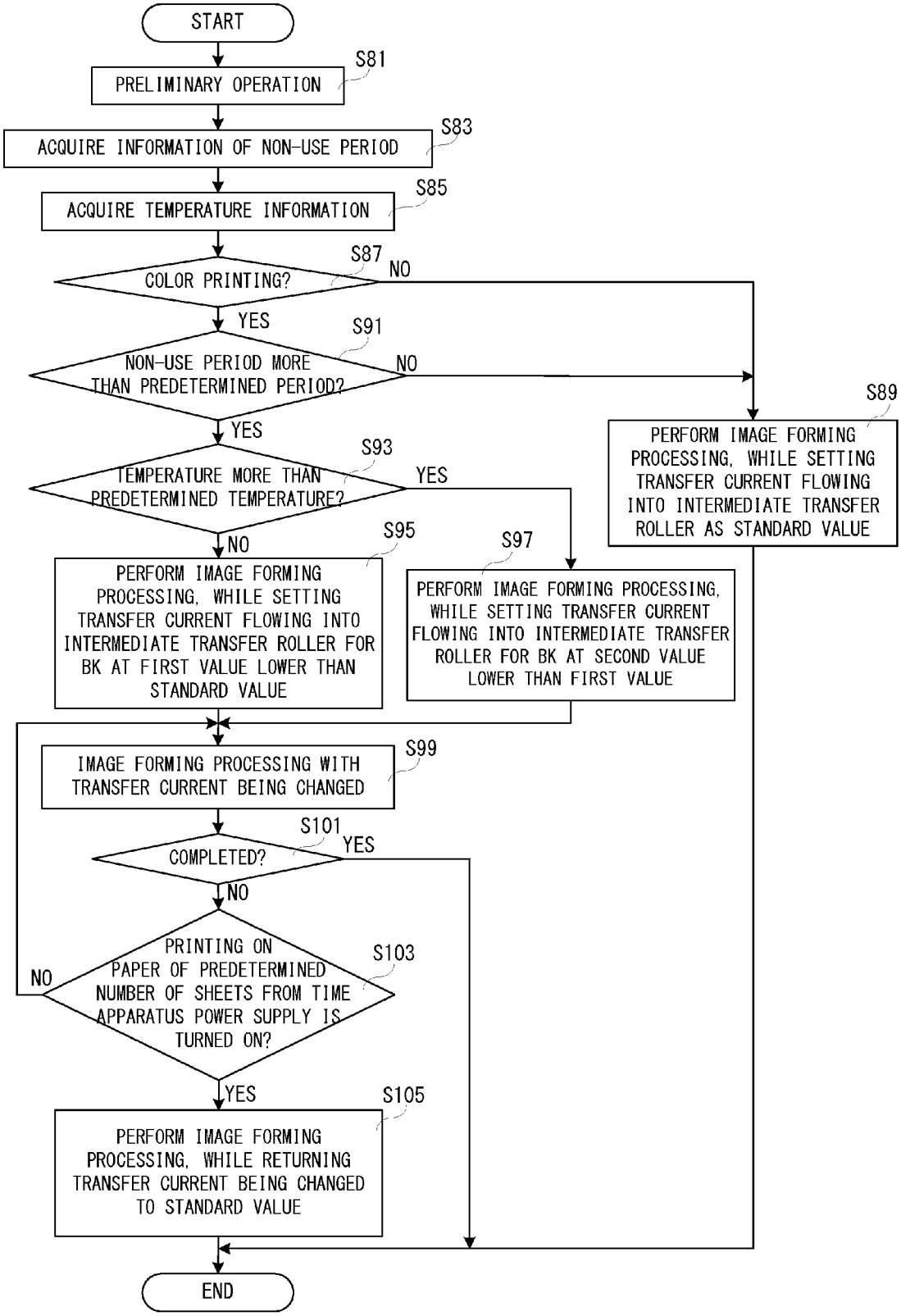
FIG. 8 is a flowchart showing an example of control processing by a CPU of an image forming apparatus that is a fourth embodiment according to the present invention.

As shown in FIG. 8, when the apparatus power supply of the image forming apparatus 10 is turned on, the CPU 80 performs a preliminary operation processing in a step S81. In a next step S83, information of the non-use period is acquired.

In a subsequent step S85, temperature information is acquired. That is, the CPU 80 acquires the information concerning the ambient temperature of the intermediate transfer belt 54 in the non-use period. For example, the temperature when the apparatus power supply is turned on is measured by the temperature sensor provided around the intermediate transfer belt 54 is read from the HDD 84 as an approximate value of the ambient temperature of the intermediate transfer belt 54 in the non-use period.

In a subsequent step S87, it is determined whether color printing is to be performed. If "NO" is determined in the step S87, that is, if a monochrome printing instruction is input, the process proceeds to a step S89 wherein the image forming processing is performed after the current value of the transfer current that flows into the intermediate transfer roller 60 is set as the standard value. On the other hand, if "YES" is determined in the step S87, that is, if a color printing instruction is input, the process proceeds to a step S91.

In the step S91, it is determined whether the non-use period is equal to or more than the predetermined period. That is, the CPU 80 determines whether the non-use period acquired in the step S83 is equal to or more than the predetermined period (14 days, for example) that is set in advance.

If "NO" is determined in the step S91, that is, if it is determined that a state is the usual state where the non-use period is less than 14 days and thus no contact trace occur on the intermediate transfer belt 54, the process proceeds to a step S89, wherein the current value of the transfer current that flows into the intermediate transfer roller 60 is set as the standard value, and the image forming processing to a paper is performed. On the other hand, if "YES" is determined in the step S91, that is, if it is determined that the non-use period is equal to or more than 14 days and the contact trace occurs on the intermediate transfer belt 54, the process proceeds to a step S93.

In the step S93, it is further determined whether the temperature is equal to or more than the predetermined temperature. More specifically, the CPU 80 determines whether the ambient temperature of the intermediate transfer belt 54 in the non-use period acquired in the step S85 is equal to or more than the predetermined temperature (28° C., for example) that is set in advance.

If "NO" is determined in the step S93, that is, if it is determined that the non-use period is equal to or more than the predetermined period and the ambient temperature of the intermediate transfer belt 54 in the non-use period is less than predetermined temperature and thus the degree of the contact trace that occurs on the intermediate transfer belt 54 is relatively small, the process proceeds to a step S95. In the step S95, the current value of the transfer current that flows into the intermediate transfer roller 60BK for black is set as a first value (+13 microamperes, for example) lower than the standard value (+15 microamperes, for example), and the process proceeds to a step S99.

On the other hand, if "YES" is determined in the step S93, that is, if it is determined that the non-use period is equal to or more than the predetermined period and the ambient temperature of the intermediate transfer belt 54 in the non-used period is less than the predetermined temperature and thus the degree of the contact trace that occurs on the intermediate transfer belt 54 is relatively large, the process proceeds to a step S97. In the step S97, the current value of the transfer current that flows into the intermediate transfer roller 60BK for black as a second value (+12 microamperes, for example) lower than the first value, and the process proceeds to a step S99.

In the step S99, the image forming processing is performed with the transfer current being changed. More specifically, the CPU 80 controls the voltage that is applied to the intermediate transfer roller 60BK from the transfer power supply 72*a* such that the transfer current set in the step S95 or S97 flows into the intermediate transfer roller 60BK for black when the toner image formed on the photoreceptor drum 36 is to be transferred to the outer peripheral surface of the intermediate transfer belt 54, and performs the image forming processing to form a color image on a paper.

In a subsequent step S101, it is determined whether the printing on the paper of the number of sheets directed by the user is completed. If "YES" is determined in the step S101, that is, if the image forming on the paper of the printing number of sheets directed by the user is completed, this entire processing is terminated with no operation. On the other hand, if "NO" is determined in the step S101, that is, if the image forming on the paper of the printing number of sheets directed by the user still remains, the process proceeds to a step S103.

In the step S103, it is determined whether the printing on the paper of predetermined number of sheets from the time that the apparatus power supply is turned on is reached. That is, it is determined whether the printing number of sheets from the time that the apparatus power supply is turned on reaches the predetermined number of sheets (45 sheets, for example).

If "NO" is determined in the step S103, that is, if not printing on the paper of predetermined number of sheets from the time that the apparatus power supply is turned on, the process returns to the step S99. On the other hand, if "YES" is determined in the step S103, that is, if the printing number of sheets from the time that the apparatus power supply is turned on reaches the predetermined number of sheets, the process proceeds to a step S105.

In the step S105, the image forming processing is performed after the current value of the transfer current flowing into the intermediate transfer roller 60BK for black is returned to the standard value. Then, the CPU 80 terminates this entire processing after the image forming to the paper of the printing number of sheets directed by the user is completed.

According to this fourth embodiment, like the first embodiment, the re-transfer of the toner can be prevented by controlling the transfer current that flows into the intermediate transfer roller 60 based on the use situation of the intermediate transfer belt 54. Therefore, it is possible to prevent the poor image due to the contact trace that occurs on the intermediate transfer belt 54 without extending the preliminary operation time of the intermediate transfer belt 54.

Furthermore, according to the fourth embodiment, since the transfer current that is supplied to the intermediate transfer roller 60BK is adequately controlled based on both of the non-use period and the environment information such as the temperature in the non-use period, it is possible to more adequately prevent the re-transfer of the toner and prevent more adequately the poor image due to the contact trace that occurs on the intermediate transfer belt 54.

In addition, although the reduction range of the transfer current is changed to be divided into two stages of the first period and the second period, the reduction range can be changed to be divided into three or more stages. Furthermore, instead of changing the reduction range of the transfer current gradually, or in addition to changing the reduction range of the transfer current gradually, the time period until the current value of the transfer current is returned to the standard value can be gradually changed.

Furthermore, in respective above-described embodiments, although the current value of the transfer current that flows into the intermediate transfer roller 60 is changed from the standard value based on the use situation of the intermediate transfer belt 54 only when a color image is to be formed, not limited to this, in forming a monochrome image, the current value of the transfer current that flows into the intermediate transfer roller 60 may be also changed from the standard value based on the use situation of the intermediate transfer belt 54.

Furthermore, in respective above-described embodiments, although the voltage that is applied to the intermediate transfer roller 60 is controlled such that the current value being changed of the transfer current is returned to the standard value at once when the time period that the intermediate transfer belt 54 is circumferentially moved reaches the predetermine time period (predetermined printing number of sheets is reached) in a case where it is necessary to return the current value being changed of the transfer current to the standard value, not limited to this, and it is possible to control the voltage that is applied to the intermediate transfer roller 60 such that the current value of the transfer current can be returned to the standard value gradually. For example, in a case where the current value of the transfer current is reduced by 3 microamperes from the standard value, when the printing number of sheets from the time that the apparatus power supply is turned on reaches the first predetermined number of sheets (15 sheets, for example), it is rendered in a state where the current value of the transfer current is reduced by 2 microamperes from the standard value, when the second predetermined number of sheets (30 sheets, for example) is reached, it is rendered in a state where the current value of the transfer current is reduced by 1 microampere from the standard value, and when the third predetermined number of sheets (45 sheets, for example) is reached, it is rendered in a state where the current value of the transfer current is returned to the standard value.

Since the contact trace of the intermediate transfer belt 54 can be recovered gradually as the time period that the intermediate transfer belt 54 is circumferentially moved increases, by gradually returning the current value of the transfer current to the standard value according to a recovery state of the contact trace, it is possible to preventing the poor image due to the contact trace of the transfer belt more adequately while suppressing of degradation of the image quality of the output image resulting from the change of the current value of the transfer current from the standard value more adequately.

Furthermore, in respective above-described embodiments, although only the transfer current that flows to the intermediate transfer roller 60BK for black (that is, the intermediate transfer roller that is arranged in the most downstream side in the movement direction of the intermediate transfer belt) is changed, the current values of the transfer currents that flow into the transfer rollers 60M, 60C and 60Y that are arranged in the upstream side may be changed from the standard value. In this case, the voltage that is applied to the intermediate transfer roller that is arranged in the downstream side in the movement direction of the intermediate transfer belt should be changed more greatly than the voltage that is applied to the intermediate transfer roller 60 that is arranged in the upstream side. This is because it is easy to occur the re-transfer of the toner on the photoreceptor drum 36 that is arranged in the downstream side in the movement direction of the intermediate transfer belt 54 rather than the photoreceptor drum 36 that is arranged in the upstream side, and in order to adequately suppress the re-transfer of the toner, it is more effective that the current value of the transfer current that flows into the intermediate transfer roller 60 that is arranged in the downstream side is greatly reduced from the standard value.

In the situation that the contact trace occurs on the intermediate transfer belt 54, for example, the image forming processing should be performed by controlling the voltage that is applied to the intermediate transfer roller 60BK for black from the transfer power supply 72*a* such that the current value of the transfer current that flows into the intermediate transfer roller 60BK is set as +12 microamperes lower than the standard value (+15 microamperes) by 3 microamperes, while controlling the voltage that is applied to the intermediate transfer rollers 60M, 60C and 60Y from the transfer power supply 72*b* such that the current value of the transfer current that flows into the intermediate transfer rollers 60M, 60C and 60Y becomes +12. 5 microamperes lower than the standard value (+15 microamperes) by 1.5 microamperes. Furthermore, it is thinkable that the transfer current to be supplied to the intermediate transfer rollers 60M, 60C and 60Y is controlled individually, and the voltage that is applied to the intermediate transfer roller 60 is greatly changed as the photoreceptor drum 36 becomes in the downstream side in the movement direction of the intermediate transfer belt 54.

Furthermore, in respective above-described embodiments, a roller system that the secondary transfer roller 44 is used when performing the secondary transfer of the toner image that is formed on the outer peripheral surface of the intermediate transfer belt 54 to a paper, but not limited to this, and a belt system using a secondary transfer belt (not shown) may be adopted. When using the secondary transfer belt, a poor image due to the contact trace that occurs on the secondary transfer belt should be prevented by controlling adequately the transfer current to be supplied to the secondary transfer roller based on the use situation of the secondary transfer belt. That is, it is intended that the term "transfer belt" in the present invention includes such a secondary transfer belt.

Furthermore, although the multifunction apparatus combining a copying machine, a facsimile, a printer, etc. is shown as the image forming apparatus 10 in respective above-described embodiments, the image forming apparatuses 10 may be either a copying machine, a facsimile, a printer, etc. and a multifunction apparatus combining at least two of them.

Although the present invention has been mentioned and illustrated in detail, it is clearly understood that the same is by way of illustration and example only and is not to be taken by way of limitation, the spirit and scope of the present invention being limited only by the terms of the appended claims.

What is claimed is:

1. An image forming apparatus in which a toner image formed on an image carrying member is transferred to a recording medium using a transfer belt that is stretched over a plurality of rollers to be circumferentially moved, comprising:

a transfer roller that is rotatably provided and brought into pressure-contact to the transfer belt;

a transfer power supply that applies a voltage to the transfer roller;

a use situation measurement unit operable to measure a use situation of the transfer belt; and a transfer current control unit operable to control a transfer current that flows to the transfer roller by controlling the voltage applied from the transfer power supply to the transfer roller based on the use situation that is measured by the use situation measurement unit; wherein when a current value of the transfer current is changed from a standard value, the transfer current control unit is operable to control the voltage applied to the transfer roller such that the current value being changed of the transfer current is returned to the standard value after the transfer belt is circumferentially moved for a predetermined time period.

2. The image forming apparatus according to claim 1, wherein the transfer current control unit is operable to control the voltage that is applied to the transfer roller such that the current value of the transfer current is gradually returned to the standard value when returning the current value being changed of the transfer current to the standard value.

3. The image forming apparatus according to claim 1, wherein a position that the transfer roller is brought into pressure-contact to the transfer belt is a position that is opposite to the image carrying member via the transfer belt and near the image carrying member, being shifted to the downstream side in the movement direction of the transfer belt than a position that the transfer belt and the image carrying member are brought into contact with each other.

4. An image forming apparatus in which a toner image formed on an image carrying member is transferred to a recording medium using a transfer belt that is stretched over a plurality of rollers to be circumferentially moved, comprising:

a transfer roller that is rotatably provided and brought into pressure-contact to the transfer belt;

a transfer power supply that applies a voltage to the transfer roller;

a use situation measurement unit operable to measure a use situation of the transfer belt; and a transfer current control unit operable to control a transfer current that flows to the transfer roller by controlling the voltage applied from the transfer power supply to the transfer roller based on the use situation that is measured by the use situation measurement unit; wherein the image carrying member and the transfer roller are respectively arranged in plural number abreast in a movement direction of the transfer belt, and the transfer current control unit is operable to change only a voltage applied to the transfer roller that is arranged in a most downstream side in the movement direction of the transfer belt when changing the current value of the transfer current from the standard value.

5. The image forming apparatus according to claim 4, wherein a position that the transfer roller is brought into pressure-contact to the transfer belt is a position that is opposite to the image carrying member via the transfer belt and near the image carrying member, being shifted to the downstream side in the movement direction of the transfer belt than a position that the transfer belt and the image carrying member are brought into contact with each other.

6. An image forming apparatus in which a toner image formed on an image carrying member is transferred to a recording medium using a transfer belt that is stretched over a plurality of rollers to be circumferentially moved, comprising:

a transfer roller that is rotatably provided and brought into pressure-contact to the transfer belt;

a transfer power supply that applies a voltage to the transfer roller;

a use situation measurement unit operable to measure a use situation of the transfer belt; and a transfer current control unit operable to control a transfer current that flows to the transfer roller by controlling the voltage applied from the transfer power supply to the transfer roller based on the use situation that is measured by the use situation measurement unit; wherein the image carrying member and the transfer roller are respectively arranged in plural number abreast in a movement direction of the transfer belt, and the transfer current control unit is operable to change the voltage applied to the transfer roller that is arranged in a downstream side in the movement direction of the transfer belt more greatly than the voltage that is applied to the transfer roller that is arranged in an upstream side in the movement direction of the transfer belt when changing the current value of the transfer current from the standard value.

7. The image forming apparatus according to claim 6, wherein a position that the transfer roller is brought into pressure-contact to the transfer belt is a position that is opposite to the image carrying member via the transfer belt and near the image carrying member, being shifted to the downstream side in the movement direction of the transfer belt than a position that the transfer belt and the image carrying member are brought into contact with each other.

8. A transfer current control method in an image forming apparatus, a processor of the image forming apparatus performing steps of:

(a) measuring a use situation of a transfer belt; and (b) controlling a voltage that is applied from a transfer power supply to a transfer roller based on the use situation that is measured in the step (a) so as to control a transfer current that flows to the transfer roller; and (c) when a current value of the transfer current is changed from a standard value in the step (b), controlling the voltage that is applied from the transfer power supply to the transfer roller such that the current value being changed of the transfer current is returned to the standard value after the transfer belt is circumferentially moved for a predetermined time period.

9. The transfer current control method according to claim 8, wherein the step c) includes controlling the voltage that is applied to the transfer roller such that the current value of the transfer current is gradually returned to the standard value when returning the current value being changed of the transfer current to the standard value.

10. A non-transitory computer-readable storage medium storing a transfer current control program for an image forming apparatus, the transfer current control program causing a processor of the image forming apparatus to perform:

measuring a use situation of a transfer belt;

controlling a voltage that is applied from a transfer power supply to a transfer roller based on the use situation so as to control a transfer current that flows to the transfer roller; and when a current value of the transfer current is changed from a standard value, controlling the voltage that is applied from the transfer power supply to the transfer roller such that the current value being changed of the transfer current is returned to the standard value after the transfer belt is circumferentially moved for a predetermined time period.

11. The non-transitory computer-readable storage medium according to claim 10, wherein the transfer current control program causes the processor of the image forming apparatus to control the voltage that is applied to the transfer roller such that the current value of the transfer current is gradually returned to the standard value when returning the current value being changed of the transfer current to the standard value.

* * * * *